US010490118B2

(12) United States Patent
Komanduri et al.

(10) Patent No.: US 10,490,118 B2
(45) Date of Patent: Nov. 26, 2019

(54) ILLUMINATION AND DISPLAY CONTROL STRATEGIES, TO MITIGATE INTERFERENCE OF ILLUMINATION LIGHT OUTPUT WITH DISPLAYED IMAGE LIGHT OUTPUT

(71) Applicant: ABL IP HOLDING LLC, Conyers, GA (US)

(72) Inventors: Ravi Kumar Komanduri, Brambleton, VA (US); Guan-Bo Lin, Reston, VA (US); An Mao, Jersey City, NJ (US); David P. Ramer, Reston, VA (US); Rashmi Kumar Raj, Herndon, VA (US)

(73) Assignee: ABL IP HOLDING LLC, Conyers, GA (US)

( * ) Notice: Subject to any disclaimer, the term of this patent is extended or adjusted under 35 U.S.C. 154(b) by 219 days.

(21) Appl. No.: 15/611,349

(22) Filed: Jun. 1, 2017

(65) Prior Publication Data

US 2018/0352626 A1 Dec. 6, 2018

(51) Int. Cl.
*G09G 3/32* (2016.01)
*H05B 33/08* (2006.01)

(52) U.S. Cl.
CPC ..... *G09G 3/32* (2013.01); *H05B 33/0842* (2013.01); *G09G 2300/023* (2013.01)

(58) Field of Classification Search
CPC ..... G09G 3/34
See application file for complete search history.

(56) References Cited

U.S. PATENT DOCUMENTS 7,864,204 B2 * 1/2011 Overes ..... H05B 37/0218 345/102
2015/0177538 A1 * 6/2015 Jepsen ..... G09G 3/20 345/690

OTHER PUBLICATIONS

Fraunhofer-Gesellschaft, Sky light sky bright—in the office, Research News, Jan. 2012—Topic 1. Retrieved from http://www.fraunhofer.de/en/press/research-news/2012/january/sky-light-sky-bright.html, dated Jan. 2, 2012, 2 pages.
Scott, K., Engineers create virtual sky for office ceilings, Technology, Jan. 2004. Retrieved from http://www.wired.co.uk/news/archive/2012-01/04/office-ceilings-made-to-mimic-the-sky, dated Jan. 4, 2012, 2 pages.

(Continued)

*Primary Examiner* — Joseph R Haley
(74) *Attorney, Agent, or Firm* — RatnerPrestia

(57) ABSTRACT

For a luminaire offering both illumination and display functionality, control strategies coordinate illumination/image output so as to mitigate interference of the illumination light output with aspects of the displayed image light output. In one example, when displaying a selected image with one or more white regions in the image, a sufficient number of selected white illumination emitters can be ON or operating in a low power state in the white regions while the rest of the luminaire output area can display the non-white elements of the image with aligned illumination emitters turned OFF. In another example, an image is displayed in a selected region of the luminaire output while illumination emitters within the area displaying the image are OFF or operating in a low power state, but illumination emitters along other parts of the luminaire output are turned ON.

17 Claims, 10 Drawing Sheets

(56) References Cited

OTHER PUBLICATIONS

Beam Labs, "Beam. The smart projector that fits in any light socket", downloaded Oct. 20, 2016 from http://beamlabsinc.com/ © 2016 Beam Labs BV, The Netherlands, 5 pages.
Amazon Launchpad, "Beam, the Smart Projector that Fits in Any Light Socket by Beam", downloaded on Oct. 20, 2016 from https://www.amazon.com/Beam-Smart-Projector-Light-Socket/dp/B017IKR2NM—Interest Based Ads © 1996-2016, Amazon.com, Inc. or its affiliates, 5 pages.
Lightpack 2, "Lightpack is an ultimate lighting accessory for your living room environment"; http://lightpack.tv/; Copyright © 2015 Lightpack; downloaded Oct. 13, 2016, 4 pages.

* cited by examiner

ILLUMINATION AND DISPLAY CONTROL STRATEGIES, TO MITIGATE INTERFERENCE OF ILLUMINATION LIGHT OUTPUT WITH DISPLAYED IMAGE LIGHT OUTPUT

TECHNICAL FIELD

The present subject matter relates to a lighting device or luminaire, and/or operations thereof, where the luminaire includes a display oriented to output image light in approximately the same direction as some or all of the illumination light, and more specifically to control strategies for use in such a luminaire to mitigate interference of illumination light output with displayed image light output.

BACKGROUND

Electrically powered artificial lighting has become ubiquitous in modern society. Electrical lighting devices are commonly deployed, for example, in homes, buildings of commercial and other enterprise establishments, as well as in various outdoor settings. Typical luminaires generally have been single purpose devices, e.g. to just provide light output of a character (e.g. color, intensity, and/or distribution) to provide artificial general illumination of a particular area or space.

More recently, there have been proposals to combine some degree of display capability with lighting functionalities. The Fraunhofer Institute, for example, has demonstrated lighting equipment using luminous tiles, each having a matrix of red (R) LEDs, green (G), blue (B) LEDs and white (W) LEDs as well as a diffuser film to process light from the various LEDs. The LEDs of the system were driven to simulate or mimic the effects of clouds moving across the sky. Although use of displays allows for variations in appearance that some may find pleasing, the displays or display-like devices are optimized for image output and do not provide particularly good illumination for general lighting applications. There have also been proposals to add controlled lighting devices to televisions sets. Other proposals suggest a lightbulb like device that can serve alternately as an illumination light source and as a projector.

Combining display and illumination functions into a single device, however, leads to other problems; and there is still room for further technical improvements.

SUMMARY

For a luminaire offering both illumination and display functionality, particularly where the display is oriented to output image light in approximately the same direction as some or all of the illumination light output, the illumination light of an intensity sufficient for a typical general lighting application may produce visual interference with the image display. Hence, examples disclosed herein coordinate illumination/image output so as to mitigate interference of the illumination light output with aspects of the displayed image light output.

A method, for example, may involve operating a first light emission matrix of a display to emit output light of an image from a luminaire. The luminaire includes the display as well as a general illumination light source. The general illumination light source includes a second light emission matrix co-located in the luminaire with the first light emission matrix of the display. The general illumination light source and the display are configured such that, at an output of the luminaire, available output regions of the light emission matrices at least substantially overlap. An area of the luminaire output is selected where general illumination light output will not unduly interfere with the output light of the image. This selection, for example, may be based on a characteristic of the image. While the first light emission matrix is emitting the output light of the image, a portion of the second light emission matrix that corresponds to the selected area operates to emit general illumination light via the selected area of the luminaire output. Concurrent with that illumination light output via the selected area, all unselected portions of the second light emission matrix are in a neutral state.

Several examples of interference mitigation strategies are disclosed. In one example, when displaying a selected image with one or more white regions in the image, a sufficient number of selected white illumination emitters can be ON in the white regions while the rest of the luminaire output area can display the non-white elements of the image with aligned illumination emitters turned OFF. In another example, an image is displayed in a selected region of the luminaire output while illumination emitters within the area displaying the image are OFF, but illumination emitters along other parts of the luminaire output are turned ON. These two strategies may be combined, and other interference mitigation strategies may be implemented alone or in combination with one or both of the specific examples.

These ON/OFF states in the examples, however, are non-limiting examples only. Image light may be output by the display even in regions where the illumination emitters are ON i.e. the white image output regions of the display need not be turned OFF completely. The illumination emitters in the non-white regions of the image also may not be completely OFF, for example, if the illumination light output intensity of such emitters is sufficiently low so as to not impact the perception of the image.

The examples also encompass lighting devices that may benefit from implementation of such an interference mitigation strategy.

For example, such a lighting device may include a luminaire having one or more matrices of light emitters configured to concurrently emit light of an image for display and illumination light. At the output of the luminaire, an available output region of the light of the image at least substantially overlaps with an available output region of the illumination light. The lighting device in this example also includes means for controlling the one or more matrices of light emitters to mitigate interference of illumination light output with concurrently emitted light of the image.

In another lighting device example, the included luminaire has a display including a first light emission matrix configured to output light from selected areas of the first emission matrix as a representation of an image. The luminaire also has a controllable general illumination light source with a second light emission matrix configured to output illumination light. The general illumination light source is co-located with the display such that an available output region of the second light emission matrix at least substantially overlaps an available output region of the first light emission matrix. This example lighting device also includes a driver system coupled to control light outputs generated by the first and second light emission matrices and a processor coupled to the driver system. The processor is configured to operate the general illumination light source and the display via the driver system, for example to operate the first light emission matrix to output the light of the image via an output of the luminaire. The processor also operates the lighting device to select an area of the output of the luminaire where general illumination light output from the second light emission matrix will not unduly interfere with the output light of the image by the first light emission matrix, based on a characteristic of the image output. While the first light emission matrix is emitting the light of the image, a portion of the second light emission matrix is operational, which corresponds to the selected area of the luminaire output, to emit the general illumination light via the selected area of the luminaire output. Concurrently, all unselected portions of the second light emission matrix are in a neutral state.

The disclosed examples also include configuration data and/or executable programming for implementing interference mitigation techniques for luminaires having concurrent image display and illumination light output capabilities.

By way of an example of this later type of subject matter, a disclosed article of manufacture might include at least one machine readable medium, one or more of which is non-transitory. The article also includes image data and an illumination light setting, embodied in the at least one medium. Programming or control data also is embodied in the at least one medium. This programming or control data is configured to implement control of operation of a general illumination light source of a luminaire when outputting general illumination light responsive to the setting while a display of the luminaire is concurrently outputting light of an image based on the image data. The control operation mitigates interference of the illumination light output with aspects of the displayed image light output.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

BRIEF DESCRIPTION OF THE DRAWINGS

The drawing figures depict one or more implementations, by way of example only, not by way of limitations. In the figures, like reference numerals refer to the same or similar elements.

DETAILED DESCRIPTION

Figure 1:
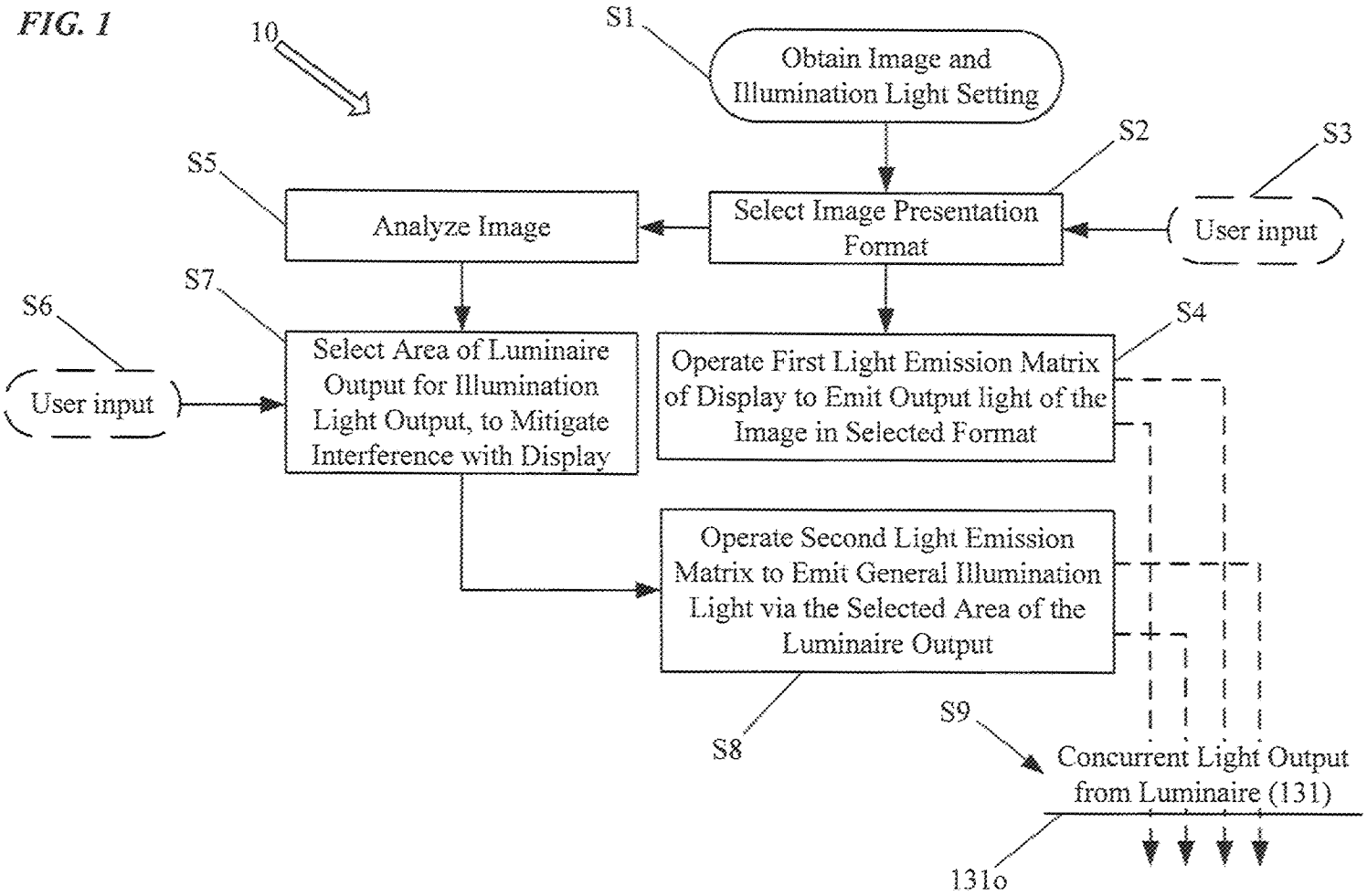
FIG. 1 is high-level flow chart of a procedure to configure a lighting device to mitigate interference of the illumination light output with aspects of a displayed image light output, of a luminaire that may support concurrent display image light output and illumination light output (e.g. for a general lighting application).

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

For a luminaire offering both illumination and display functionality, the various examples disclosed herein relate to control strategies that coordinate illumination/image output so as to mitigate interference of the illumination light output with aspects of the displayed image light output. In one control strategy example, when displaying a selected image with one or more white regions in the image, a sufficient number of selected white illumination emitters can be ON in the white regions while the rest of the luminaire area can display the non-white elements of the image with aligned illumination emitters in a neutral operating state, e.g. turned OFF or emitting light at an intensity low enough not to unduly disrupt perception of non-white areas of the displayed image. In another control strategy example, an image is displayed in a selected region of the device output while illumination emitters within the area displaying the image are OFF, but illumination emitters along other parts of the device output are turned ON. These two strategies may be combined, and other interference mitigation strategies may be implemented alone or combination with one or both of the specific examples.

Also, an ON state for example, an ON state of the illumination emitters, need not be full ON maximum intensity or even the same intensity for all emitters in the ON state at a given time. Using the illumination emitters by way of an example, some of the intended ON/active state emitters may be 100% ON, while other emitters selected to be ON may be ON at 75% of their maximum intensity, and other emitters selected to be ON may be ON at 50% of their maximum, etc. Emitters at different ON-state intensities may be at selected locations distributed across the luminaire output or grouped in various ways to produce one or more illumination light output intensity gradients at regions of the luminaire output.

The neutral operational state of one or more emitters or of a portion of either light emission matrix (matrix of emitters of the display or of the general illumination light source) may refer to a zero light emission state of the emitter(s) or portion(s) of an emission matrix. A neutral operational state of emitter(s) or portion(s) of any emission matrix may also be a low power light generation state. For general illumination light emission, for example, such low power operation would be low enough not to unduly interfere with the light output of the image, e.g. an output having one tenth of normal illumination output intensity, or an output having an illumination light output intensity the same as or less than light output intensity of display pixels in the vicinity. By way of a display example, a display emitter or portion of the emission matrix may be in a neutral operational state when OFF or when emitting light but in a non-display manner, e.g. emitting white or colored light in a manner intended to contribute to general illumination rather than to output light of a specific visible image.

For a LED display with narrow illumination)(±15°, for example, the maximum illumination emitter brightness is ~400 times that of the display emitter brightness. Within the illumination angles, the glare is too high for concurrent viewing of the image light output from the display pixel emitters. For viewing the fixture outside these angles, however, it has been found that by operating the illumination emitters about $1/10^{th}$ or lower of their maximum level, the interference may be significantly reduced. In another approach for use with such a display example, the illuminance (measured in lux=candela per unit area) of an otherwise potentially interfering illumination emitter could be at least one order of magnitude lower than that of any image light emitter in the vicinity so that the perceived image would not be seriously disturbed by the illumination light from the potentially interfering emitter.

The term "luminaire," as used herein, is intended to encompass essentially any type of device that processes energy to generate or supply artificial light, for example, for general illumination of a space intended for use of or occupancy or observation, typically by a living organism that can take advantage of or be affected in some desired manner by the light emitted from the device. However, a luminaire may provide light for use by automated equipment, such as sensors/monitors, robots, etc. that may occupy or observe the illuminated space, instead of or in addition to light provided for an organism. However, it is also possible that one or more luminaries in or on a particular premises have other lighting purposes, such as signage for an entrance or to indicate an exit. In most examples, the luminaire(s) illuminate a space or area of a premises to a level useful for a human in or passing through the space, e.g. general illumination of a room or corridor in a building or of an outdoor space such as a street, sidewalk, parking lot or performance venue. The actual source of illumination light in or supplying the light for a luminaire may be any type of artificial light emitting device, several examples of which are included in the discussions below.

The illumination light output of a luminaire, for example, may have an intensity and/or other characteristic(s) that satisfy an industry acceptable performance standard for a general lighting application. The performance standard may vary for different uses or applications of the illuminated space, for example, as between residential, office, manufacturing, warehouse, or retail spaces.

Terms such as "artificial lighting," as used herein, are intended to encompass essentially any type of lighting in which a luminaire produces light by processing of electrical power to generate the light. A luminaire for artificial lighting, for example, may take the form of a lamp, light fixture, or other luminaire that incorporates a light source, where the light source by itself contains no intelligence or communication capability, such as one or more LEDs or the like, or a lamp (e.g. "regular light bulbs") of any suitable type.

In the examples below, the luminaire includes at least one or more components forming a lighting source for generating the artificial illumination light for a general lighting application as well as a co-located display device, e.g. integrated/combined with the lighting component(s) of the lighting source into the one structure of the luminaire. In several illustrated examples, such a combinatorial luminaire may take the form of a light fixture, such as a pendant or drop light or a downlight, or wall wash light or the like. Other fixture mounting arrangements are possible. For example, at least some implementations of the luminaire may be surface mounted on or recess mounted in a wall, ceiling or floor. Orientation of the luminaires and components thereof are shown in the drawings and described below by way of non-limiting examples only. The luminaire with the lighting component(s) and the display device may take other forms, such as lamps (e.g. table or floor lamps or street lamps) or the like. Additional devices, such as fixed or controllable optical elements, may be included in the luminaire, e.g. to selectively distribute light output from the display device and/or the illumination light source. Luminaires in the examples shown in the drawings and described below have display and illumination components oriented to output image light in approximately the same direction as some or all of the illumination light.

Hence, at an output of the luminaire, available output regions of the light emission matrices of the general illumination light source and the display at least substantially overlap. For example, the image light and illumination light may be emitted from a common output area or surface of the luminaire, although the two types of light may have somewhat different angular light distributions and/or emerge via different portions of the output area or surface of the luminaire. In an example luminaire with a common output area or surface, if the overlap of the available output regions is complete, both matrices extend across and include sufficient controllable emitters to selectively emit display light and illumination light across the entire luminaire output. In such an example luminaire, the emission matrices also can selectively emit display light and illumination light through any selected smaller portion or area within the luminaire output. Other arrangements of the emission matrices supporting concurrent image output and controllable general illumination, with less complete overlap of the available output regions may still serve as the luminaires in lighting devices that implement the interference mitigation strategies under consideration herein. A luminaire of a type supporting display and general illumination functions may operate in various modes, e.g. with the display ON while the illumination is OFF or with the display OFF while the illumination is ON. The interference mitigation strategies under consideration here, however, are most useful when a luminaire is emitting at least some display light and at least some general illumination light concurrently.

Terms such as "display" (noun) and "display device" as used herein are intended to encompass essentially any type of hardware device that selectively processes energy to controllably output light representing an image. Display devices may or may not include light generating elements. A pixel is a unit area of an image. On a display device, for example, a pixel is point or small unit of area of light as part of an image presented in the image display output. A display may be selectively controlled to emit light of a different color and intensity at each pixel point/area of the image display output. The image output light may be generated directly by the display pixel emitters (e.g. by direct emissions from LEDs, OLEDs or plasmas at the pixel points of the display), by controlled filtering of source light (e.g. by red, green, blue LCD filters at the pixel points), or by reflection of source light (e.g. by electrophoretic ink pixel points). In other examples of the image display device, a projector of any suitable type may project the display image onto a transmissive or reflective screen. In this later case, the combination of the projector and screen form the display. In a further alternative example, the projector (alone) may be the display device located/configured to output light to project the image onto a structural surface (e.g. wall or ceiling) not itself a component of the luminaire.

Terms such as "lighting device" or "lighting apparatus," as used herein, are intended to encompass essentially any combination of an example of a luminaire discussed herein with other elements such as electronics and/or support structure, to operate and/or install the particular luminaire implementation. Such electronics hardware, for example, may include some or all of the appropriate driver(s) for the illumination light source and the display, any associated control processor or alternative higher level control circuitry, and/or data communication interface(s). As noted, the lighting component(s) and display are co-located into an integral unit, such as a light fixture or lamp implementation of the luminaire. The electronics for driving and/or controlling the lighting component(s) and the display may be incorporated within the luminaire or located separately and coupled by appropriate means to the light source component(s) and the display device.

The term "lighting system," as used herein, is intended to encompass essentially any type of system that either includes a number of such lighting devices coupled together for data communication or a lighting device coupled together for data communication with one or more control devices, such as wall switches, control panels, remote controls, central lighting or building control systems, servers, etc.

In several of the examples, the lighting device is software configurable, by programming instructions and/or setting data, e.g. that may be communicated to a processor of the lighting device via a data communication network of a lighting system. Configurable aspects of lighting device operation may include one or more of: a selected image (still or video) for presentation as the image output from the display, and one or more parameters (such as intensity and various color related characteristics) of the illumination light output. If the luminaire also includes an optical device or system for variably controlling or modulating the light output distribution(s), as in several examples, one or more parameters of the output distribution (e.g. beam shape and beam angle of the image light and/or the illumination light) also would be configurable by setting data or instructions communicated to and/or stored in the lighting. An example of a software configurable lighting device, with the luminaire thereof installed for example as a panel or pendant type light fixture, may offer the capability to emulate performance of a variety of different lighting devices for general lighting applications, while presenting any desired appearance via the image display output.

The term "coupled" as used herein refers to any logical, physical or electrical connection, link or the like by which signals produced by one element are imparted to another "coupled" element. Unless described otherwise, coupled components, elements or devices are not necessarily directly connected to one another and may be separated by intermediate components, elements, devices or communication media that may modify, manipulate or carry the signals.

Light output from the luminaire may carry information, such as a code (e.g. to identify the luminaire or its location) or downstream transmission of communication signaling and/or user data. The light based data transmission may involve modulation or otherwise adjusting parameters (e.g. intensity, color characteristic or distribution) of the illumination light out or an aspect (e.g. modulation of backlighting and/or adding a detectable code to portion of a displayed image) of the light output from the display device.

Reference now is made in detail to the examples illustrated in the accompanying drawings and discussed below. FIG. 1 illustrates an example 10 of a method of operating a luminaire 131 (an example of which is discussed in more detail later, e.g. in the discussion of an example lighting device 109 with regard to FIG. 6). The luminaire 131 provides general illumination and displays an image, and the method of operation 10 entails implementation of a strategy to mitigate interference of the illumination light output with aspects of the displayed image light output, when the luminaire 131 concurrently outputs the illumination light and the light of the image.

For purposes of discussion of the method 10, the luminaire 131 in the example includes a display as well as a general illumination light source. In some of the more specific examples of luminaires like 131, the display and the general illumination light source include respective light emission matrices co-located in the luminaire 131. The general illumination light source and the display are configured such that, at an output 131*o* of the luminaire 131, available output regions of the light emission matrices at least substantially overlap. In specific examples, the overlap extends across the entire output 131*o* of the luminaire 131, so that each matrix of emitters can output respective display or general illumination light via all of the luminaire output 131*o* or via any one or more smaller areas or portions of the luminaire output 131*o*. Lighting equipment with lesser degrees of overlap of illumination and display light outputs, however, may still benefit from interference mitigation as described herein.

The example method 10 of FIG. 1 begins with a step S1 of obtaining an image and data for one or more illumination light settings. The image may be a still image or video, for example, from a file or generated from an image sensor in real time or generated by computer animation programming. At this point, the image may be on a server or stored in a lighting device. Alternatively, the image data may be streamed to the lighting device. The illumination light setting, for example, may include one or more lighting parameters, such as overall illumination intensity, color characteristic(s) for the general illumination light output, or illumination distribution (e.g. steering and/or shaping parameters), if the lighting device has selectable distribution control capability. Similar to the image data, the data for the one or more illumination light settings may be stored on a server or stored in the lighting device or streamed to the lighting device.

The example method 10 of FIG. 1 includes a step S2 of selecting an image presentation format. Optimally, step S2 may be responsive to a user input step at S3. The selection at S2 may lead to output of the image as obtained in S1, for example, without modifying the format of the image data. In other cases, the selection may lead to a change in the format of the data and thus the image. For example, a user may select a desired area of the luminaire output surface 131*o* less than the entire area of output 131*o* for output of the image, which might then entail shrinking or cropping the image to fit the selected smaller image output area. Alternatively or in addition, format selection may be based on parameters of the image vis-à-vis capabilities of the display (or the luminaire output area selected for display output), e.g. to down-sample high resolution of the initially obtained image data to a data format suitable for output via a lower resolution display (or via a selected smaller portion of the display).

Step S4 involves operating a first light emission matrix of the display to emit output light of an image from the luminaire 131. Depending on the image presentation format selected in step S2, the operation step S4 may operate all of the emitters of the first light emission matrix so that the display outputs light of the image across the entire area of the luminaire output 131*o*. In other control scenarios, the image presentation format selected in step S2 may limit operation to one or more selected portions of the first light emission matrix in step S4 so that the display outputs light of the image via some but not all of the area of the luminaire output 131*o*. For example, some interference mitigation strategies select an image area, and the step S4 of operating the first light emission matrix involves limiting of emission of the output light of the image to the portion of the luminaire output selected for output of the image.

Steps S5 to S8 implement a strategy to mitigate interference of the illumination light output with aspects of the displayed image light output via the overlapping output areas at luminaire output 131*o*. The example involves an analysis of the image in step S5 and may optimally involve a user input received in step S6, which are used in the selection of an area of the luminaire output in step S7. In step S7, an area of the luminaire output is selected where general illumination light output will not unduly interfere with the output light of the image. This selection, for example, may be based on a characteristic of the image, as a result of the analysis in S5 and/or in response to a selection of the area by user input in S6. For example, the characteristic of the image may relate to area(s) of the output image that is/are white, a sub-portion of the output area of the luminaire output 131*o* that is not outputting the image light, or the like.

Steps such as any or all of S1 to S7 may be implemented on a particular lighting device, in whole or in part in a server or other computing device in communication with the lighting device or by some other controller or the like of a lighting system.

Step S8 in the example involves operating the second light emission matrix, i.e. the emission matrix of the general light illumination source in this example, to emit general illumination light via the selected area of the luminaire output 131*o*. The area of the luminaire 131*o* selected for reduced interference general illumination light output, however, does not encompass the entire area of the luminaire 131*o*. Some of the area of the luminaire 131*o* is not included in the selection. Step S8 in the example therefore also involves not operating one or more portions of the second light emission matrix, i.e. the emission matrix of the general light illumination source in this example, so as to not emit any of the general illumination light via the unselected portions of that matrix (and thus not emit any such illumination via any area not included in the area of the luminaire 131*o* selected in step S7).

The operation in step S8 may also select a suitable number of general illumination light emitters and/or the intensity or color of the general illumination light emitters that are operating based on one or more parameters of the setting data obtained as part of step S1.

In general, the step of operating the portion of the second light emission matrix (at S8) may involve operating general illumination light emitters in the portion of the second light emission matrix selected to mitigate interference in a manner sufficient for the general illumination light output emitted from the luminaire to satisfy the determined operating parameter. The control to achieve the parameter intended for the general illumination light output from the luminaire can be achieved in a variety of different ways. It may be helpful to consider a couple of examples. In one example, the determined operating parameter is an intensity intended for the general illumination light output from the luminaire. In this example, the step of operating general illumination light emitters (in step S8) operates a number but not all of the general illumination light emitters in the portion of the second light emission matrix. The operated number of the general illumination light emitters is sufficient for the luminaire output to achieve the intended intensity. In another example where the determined operating parameter is an intensity intended for the general illumination light output from the luminaire, the step of operating general illumination light emitters (in step S8) includes driving the general illumination light emitters in the portion of the second light emission matrix at a power level sufficient for the luminaire output to achieve the intended intensity.

As a result of steps S4 and S8, the emission matrices of the display and the general illumination light source concurrently provide output light of the image as well as general illumination light output in step S9 via the luminaire output 131*o*. In the example, while the first light emission matrix is emitting the output light of the image (S4), a portion of the second light emission matrix that corresponds to the selected area operates to emit general illumination light (S8) via the selected area of the luminaire output 131*o*. Concurrent with that illumination light output via the selected area, all unselected portions of the second light emission matrix are not operating.

The strategy for controlling or mitigating interference need not eliminate all potential optical interference of the illumination light output with aspects of the displayed image light output. The mitigation should reduce any such interference so that the illumination light output does not unduly interfere with the image display output, e.g. does not prevent a human observer from perceiving the content of the image from the display output while the luminaire is concurrently outputting the general illumination light output (for example, in accordance with the particular illumination setting(s)).

The operations to select an area of the luminaire output where general illumination light output from the second light emission matrix will not unduly interfere with the output light of the image by the first light emission matrix and the select emitters of the second light emission matrix to emit general illumination light via the selected area while other emitters are concurrently in a neutral state may be implemented a number of different ways. It may be helpful to consider a couple of process flows, for two different interference mitigation strategies, with respect to the flow charts shown by way of examples in FIGS. 1A and 1B.

Figure 1A:
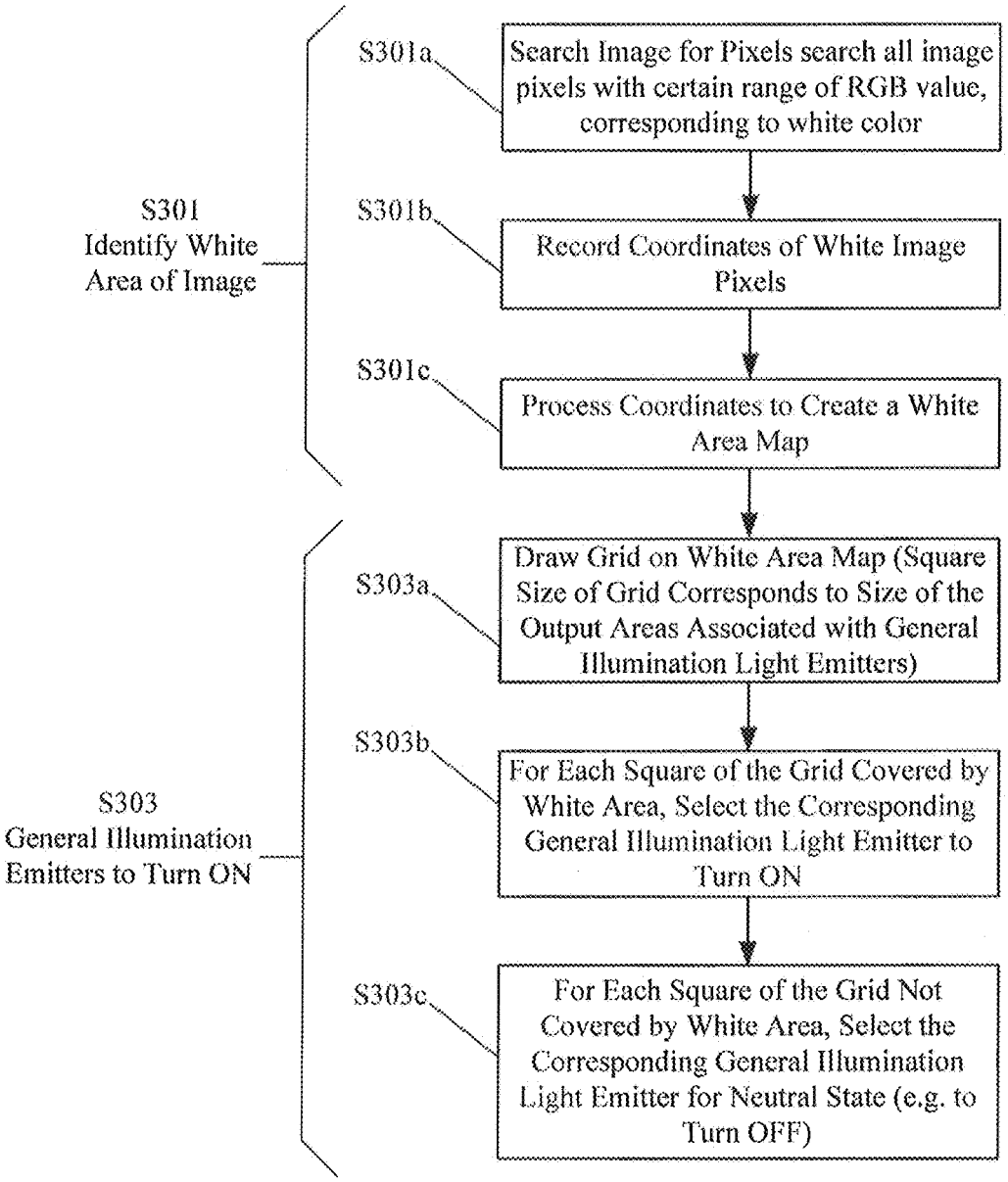
FIGS. 1A and 1B are flow charts of two somewhat more detailed examples of processes to provide interference mitigation for a lighting device that may support concurrent display image light output and illumination light output.
Figure 2:
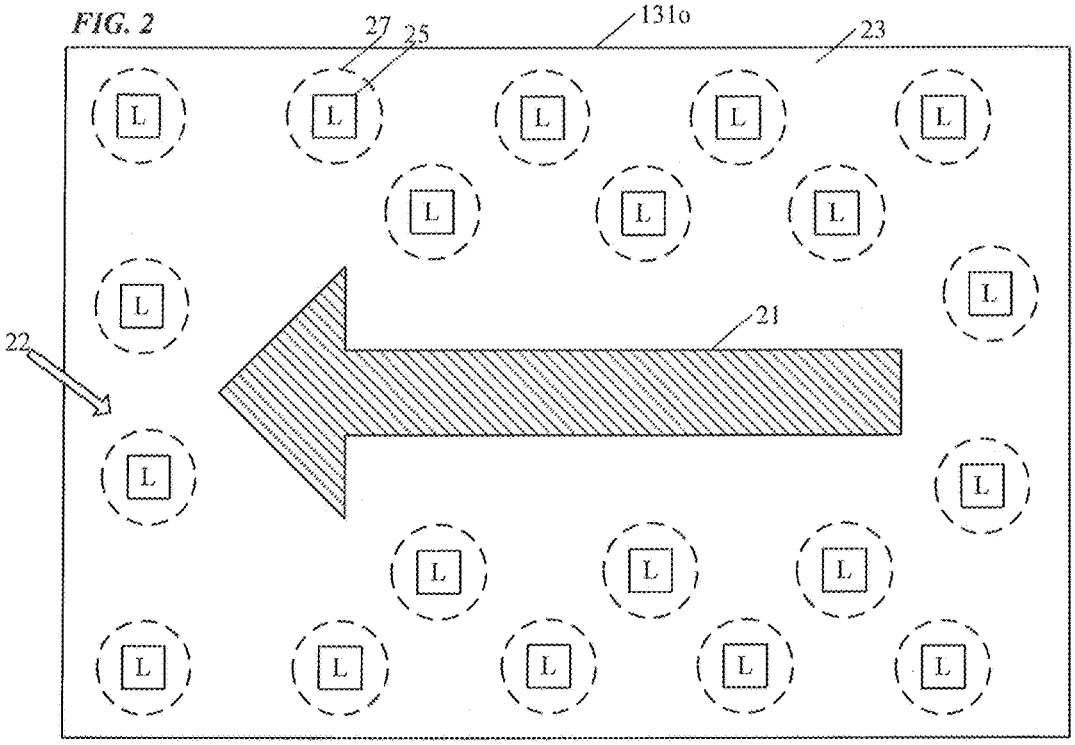
FIGS. 2 to 5 are simplified, stylized representations of combined display and illumination outputs from a luminaire, which illustrate different examples of interference mitigation strategies.

The process flow of FIG. 1A relates to a strategy that selects one or more white areas of an image, activates general illumination light emitters in that area and maintains other general illumination light emitters in a neutral state. An example of a luminaire output implementing this strategy is shown in FIG. 2, as discussed in more detail later.

At a high level, the process involves a first sub-routine S301 to identify white area in an image that will be displayed on the luminaire. This sub-routine S301 may be implemented in a variety of ways. For discussion and illustration purposes, the example assumes image data for a multi-pixel first emission matrix where the emitters at the pixel points of that matrix emit selected/controllable amounts of red (R), green (G) and blue (B) light, e.g. from a combined RGB LED type emitter for each pixel. In the example, the sub-routine S301 involves a step S301*a* to search the image data to identify all image pixels with RGB values in a range corresponding to white color output on the color gamut of the display, for example, in a range of values (R, G, B)=(250-255, 250-255, 250-255). Step S301*b* then entails recording coordinates of the white image pixels identified in step S301*a*. Step S301*c* processes those coordinates to create a data table corresponding to a white area map. Although the map could be display, e.g. as a map image on an operator's terminal, the map data table may only need to be stored for further processing as outlined below.

At the high level, the process next involves a second sub-routine S303 to determine which general illumination light emitters to turn ON. This sub-routine S303 may be implemented in a variety of ways. In the example, the sub-routine S303 involves a step S303*a* to process the data to effectively draw a grid on the white area map. The square size of the openings in the grid corresponds to the size of the output areas associated with individual general illumination light emitters (of the second emission matrix). In step S303*b*, each square of the grid that corresponds to (is "covered by") white area of the white image map is selected, and the corresponding general light illumination emitter is selected and can then be turned ON for illumination light output. Then, for each square of the grid not covered by white area, step S303*c* involves selecting the corresponding general illumination light emitter of the second emission matrix for neutral state (e.g. to turn OFF).

Figure 1B:
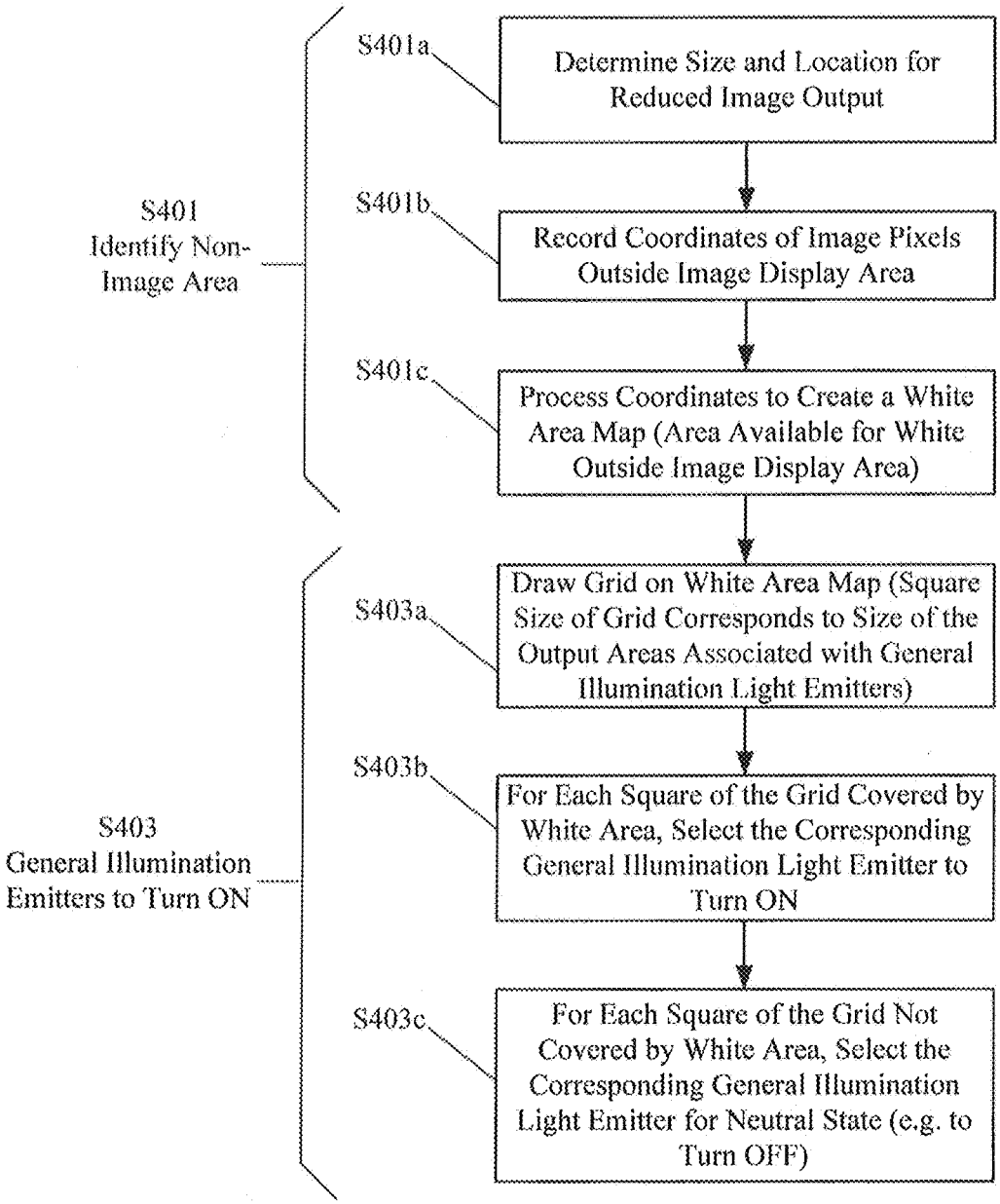
Figure 3:
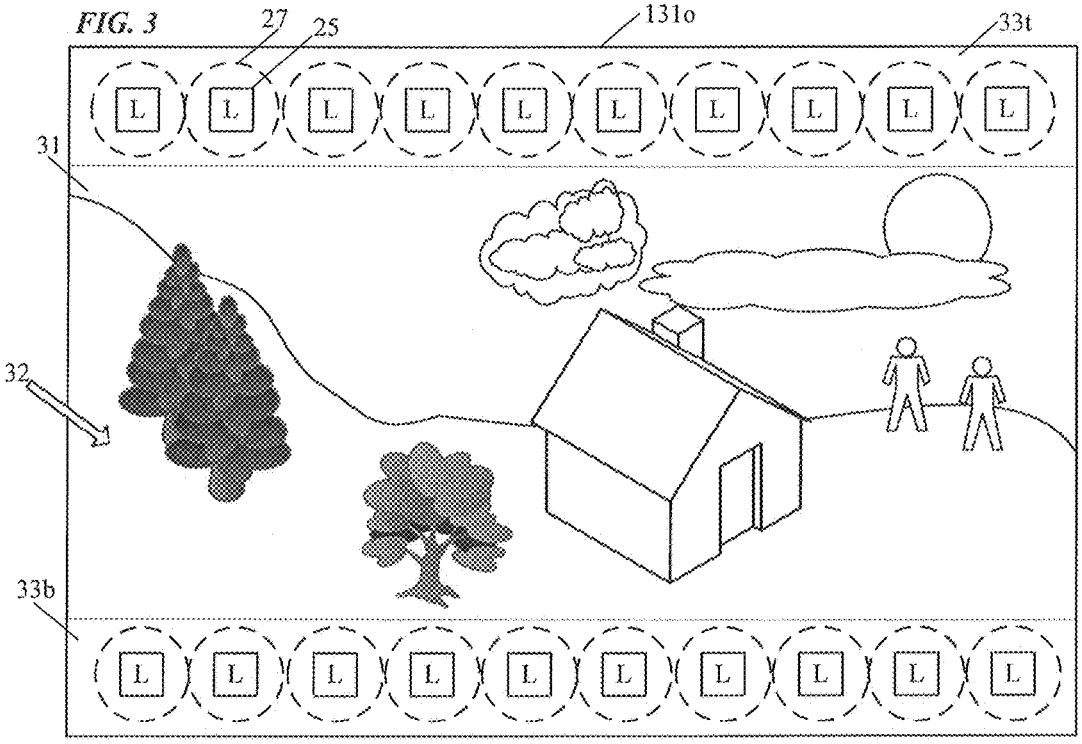

The process flow of FIG. 1B relates to a strategy in which the image is output only in a particular part (not all) of the luminaire output area. At a high level, this strategy selects one or more non-image areas as potential white illumination outputs areas, activates general illumination light emitters in the selected area(s) and maintains other general illumination light emitters in a neutral state. An example of a luminaire output implementing this strategy is shown in FIG. 3, as discussed in more detail later.

At a high level, the process involves a first sub-routine S401 to identify non-image area in that will correspond to the output of the luminaire when concurrently providing image and general illumination light outputs. This sub-routine S401 may be implemented in a variety of ways. In the example, the sub-routine S401 involves a step S401*a* to determine the size and location for a reduced image output, e.g. to display the via some but not all of the area of the output of the luminaire. Step S401*b* then entails recording coordinates of the image pixels that are outside the image display area for the reduced size image output identified in step S401*a*. Step S401*c* processes those coordinates to create a data table corresponding to a white area map, in this case, an area available for white light illumination output outside the image display area. Although the map could be display, e.g. as a map image on an operator's terminal, the map data table may only need to be stored for further processing as outlined below.

At the high level, the process next involves a second sub-routine S403 to determine which general illumination light emitters to turn ON. This sub-routine S403 may be implemented in a variety of ways. In the example, the sub-routine S403 involves a step S403*a* to process the data to effectively draw a grid on the white area map. As in the earlier example, the square size of the openings in the grid corresponds to the size of the output areas associated with individual general illumination light emitters (of the second emission matrix). In step S403*b*, each square of the grid that corresponds to or is "covered by" white area (is a non-image output area in this example) of the white image map is selected; and the corresponding general light illumination emitter is selected and can then be turned ON for illumination light output. Then, for each square of the grid not covered by such white non-image area, step S403*c* involves selecting the corresponding general illumination light emitter of the second emission matrix for neutral state (e.g. to turn OFF).

As noted, the procedures of FIGS. 1A and 1B are examples only. Other procedures or algorithms may be used to implement the interference mitigation strategies of FIGS. 2 and 3 or other appropriate interference mitigation strategies. For example, U.S. patent application Ser. No. 15/198,712, filed Jun. 30, 2016, entitled "enhancements of a Transparent Display to Form a Software Configurable Luminaire" (the entire contents all of which are incorporated herein by reference) discloses a technique to maximize contrast ratio in a software configurable luminaire that concurrently provides both image display and general illumination light outputs. As an alternative to white area identification, the contrast maximization process of the Ser. No. 15/198,712 application can be modified to identify the brightest regions in the image and turn the corresponding illumination regions of the general illumination light source matrix ON, while turning OFF the remaining regions of that second light emission matrix. Another related approach might involve pre-modification of the image data to include bright regions in sections of the image to allow illumination regions to be ON in those sections of the emission matrix of the general illumination light source.

Several examples of interference mitigation strategies are disclosed. FIGS. 2 to 5 are simplified, stylized representations of combined display and illumination outputs from a luminaire. Those drawings illustrate several different examples of interference mitigation strategies as might be implemented at different times during operation of the same luminaire 131, such as in the lighting device of FIG. 6.

Although other point sources may be used as the emitters in the second emission matrix, of the general illumination light source, for purposes of discussion, the examples of FIGS. 2 to 5 represent a luminaire implementation in which the emitters of that matrix are light emitting diodes or "LEDs" (L).

To illustrate the mitigation strategies, the drawings show the four examples as if the same number of emitters, the LEDs 25 in the illustrated examples, are on and together emit approximately the same total amount of general illumination light via their associated output areas 27 available at the output 131*o* of the luminaire. Other LED type emitters in other portions of the matrix of the general illumination light source, corresponding to other areas of the luminaire output 131*o*, are not selected and are not operating in the states shown in FIGS. 2 to 5. The unselected LEDs are not operating in the illustrated states and therefore are omitted from the drawings.

Assuming operation of the selected active LEDs 25 at the same respective intensity state in the four examples shown in FIGS. 2 to 5, the general illumination light output provided by the illumination light source in those four examples would be the same overall intensity, e.g. if that source (only, without display adjustment) is driven according to the same illumination light setting(s) data obtained in step S1 in the method 10 of FIG. 1. The number of LEDs 25 shown in the active operating state and use of the same LED output intensities, however, are merely given by way of example only.

The number of active general illumination emitters and the operational parameters of the active illumination source emitters (e.g. individual intensities and/or color), however, may be adjusted while maintaining an overall illumination setting for the outputs of the luminaire, in response to or in coordination with variations in the light output of the image. In a lighting device having a luminaire that offers combined general illumination and image output capabilities, image data related to an image to be output by the display may need to be transformed, e.g. to a resolution compatible with the display and/or so that the display light output has a desired contribution (such as intensity) to the general illumination function). For operation of such a lighting device, control data related to general illumination light generation also may be modified such that the produced image and the generated illumination have a desired result, e.g. desired intensity and possible color characteristic for general illumination and/or a desired color range/resolution in the image output. The processing of the image and setting data may be configured, for example, to transform an image selection and/or modify a general illumination generation selection such that output of the image by display device produces a desired quality image and light from the display together with the illumination light output from the general illumination source appropriately illuminates a space served by the illumination. These data processing functions may be implemented in the lighting device or in another processing device, such as a host computer or server that can communicate with the lighting device. Examples of the processing and an implementation of the processing in the lighting device are disclosed in U.S. patent application Ser. No. 15/211,272, filed Jul. 15, 2016, entitled "Multi-Processor System and Operations to Drive Display and Lighting Functions of a Software Configurable Luminaire:" and U.S. patent application Ser. No. 15/357,143, filed Nov. 21, 2016, entitled "Interlaced Data Architecture for a Software Configurable Luminaire;" the contents of both of which are entirely incorporated herein by reference.

Turning now more specifically to the examples of interference mitigation in FIGS. 2 to 5, those drawings are plan views of the luminaire output 131*o*, as it might appear if a person looked at the output 131*o* during concurrent image light output and illumination light output, albeit for different displayed images and different examples of interference mitigation strategies. For ease of illustration, these examples assume that one of the first and second emission matrices is at least substantially transmissive with respect to light output of the other of the first and second light emission matrices and that the size of the emitters of the emission matrix of the general illumination light source (the second emission matrix) is larger than the pixel point size of the emitters of the emission matrix of the display (the first second emission matrix). Those relative sizes, however, are shown by way of non-limiting example only. In these examples, the entire output area of the luminaire output 131*o* is available to both general illumination and image light output functions; that is to say, the available output area for the display emission matrix completely overlaps with and is the same as for the available output area for the general illumination light source emission matrix. The degree of overlap may not be as complete as in these examples.

FIG. 2, for example, illustrates distribution over the output area of the luminaire at 131*o* of output light from the display and illumination light output from the general illumination light source so as to "hide" typically higher intensity white illumination light emissions amongst lower intensity white light emissions of the image output. The simple example represents an image output of a colored arrow 21 (e.g. a red arrow) surrounded by white area 23 of the image 22. Such an image 22, for example, might provide an arrow 22 for a sign function pointing the direction to a location of interest, e.g. a building entrance or exit, a parking space, etc. In this example, the image 22 containing both the arrow 21 and the white area 23, is output across the entire area of the luminaire output 131*o*.

In the example of FIG. 2, all of the first matrix for generating the image output light from the display is operated so as to output light of the image 22 across the entire area of luminaire output 131*o*. Each emitter of the entire matrix of the display generates a pixel of light of the image. Alternatively, some display light emitters near active illumination light emitting LEDs 25 may be turned OFF or operating in a manner to contribute to general illumination rather than output specific light of the image.

The interference mitigation strategy in the example of FIG. 2 involves selecting one or more areas of the luminaire output (at step S7 in method 10 of FIG. 1) that corresponds to an area where the output light of the image emitted by the first light emission matrix via the output 131*o* will be a white portion of the image. This selection may include the entire white output area 21, for example, if it is desirable to activate all LEDs of the general illumination light source matrix that would emit through the entire area 21, (but not through the area outputting light of arrow 21), so as to achieve a particular overall illumination intensity. In the example actually shown, however, the selection step selects a number of areas 27 within the overall white area 23 that correspond to a selected smaller number of LEDS 25. All of the selected areas 27 of the luminaire output 131*o*, however, are inside the area 23 where the output light of the image 22 emitted by the first light emission matrix will be white.

The LEDs 25 of the general illumination matrix that correspond to and output white illumination light via the areas 27 of the luminaire output 131*o* are selected and operated (in step S8 in the method example 10 of FIG. 1). The selected LEDs 25 thus are the portion of the light emission matrix of the general illumination light source, that corresponds to the selected areas 27 of the luminaire output 131*o*, and emit general illumination light via the areas 27 during output of light of the image 22 in the example of FIG. 2. The light emission matrix of general illumination light source however, includes other emitters not visible in the drawing (because not currently operating). The other/unselected emitters in other portions of the second light emission matrix of the general illumination light source include emitters that otherwise would emit white light through the arrow 21 and interfere with that non-white portion of the image 22. Such emitters are in a neutral operational state, e. g. OFF or operating at a low enough intensity as to mitigate interference with the image light output from the display.

In luminaires utilizing some transparent display technologies, the display brightness is one to two orders of magnitude lower than that of the illumination emitters. Rather than operating the illumination emitters at a level where they may not sufficiently contribute to the luminaire output, the illumination emitters may just be turned OFF. Although white general illumination emitters could be ON at some low intensity, turning them ON with some low resolution type transparent display configurations tends to noticeably degrade the display image quality.

Hence, for purposes of further discussion of the examples shown FIG. 2 and later drawings, other unselected emitters in other portions of the second light emission matrix of the general illumination light source also includes some emitters that if operational would emit light through other portions or areas of the white area 21 outside but not included in the areas 27; and those additional white illumination light emitters also are OFF in the illustrated output state.

If feasible while achieving desired illumination intensity, per the illumination light setting, the selected areas 27 and associated emitters 25 may be separated sufficiently away in the luminaire output 131*o* from the non-white part(s) of the image 22, for example away from the edge of the arrow 21, that the white illumination light output by the active LEDs 25 does not compromise the display of the non-white part(s) of the image. If needed to achieve the desired illumination characteristic(s), however, the selected areas 27 and associated emitters 25 may be somewhat closer to the edge of the non-white part(s) of the image 22, for example close to the edge of the arrow 21, but not inside the non-white part(s) of the image. If closer, there may be some blurring of the edge of the non-white part of the image due to the illumination light. Even in the latter case, with somewhat close white light emission, the area selection and associated emitter operation in this example still maintains sufficient separation of white illumination light emission from non-white light emissions in the image light output such that any interference of this type is sufficiently limited to allow a person observing the luminaire output 131*o* at an expected distance range from the luminaire to still readily see and understand the content of the output image 22.

Hence, in the example of FIG. 2, when displaying a selected image 22 with one or more white regions 23, 27 in the image, a sufficient number of selected white illumination emitters can be ON in the white region(s) 23 or 27 while the rest of the area of luminaire output 131*o* can display the non-white element(s) 21 of the image 21 with all illumination emitters aligned with the non-white element(s) 21 turned OFF. At least some of the unselected portions of the second light emission matrix therefore correspond to one or more areas of the luminaire output 131*o*, such as the area outputting the light of the red arrow 21, where the output light of the image emitted by the first light emission matrix will be non-white in color.

In another example, shown in FIG. 3, an image 32 is displayed in a selected region 33 of the luminaire output 131*o*, but not the entire available area of the luminaire output 131*o*. During such output of light of the image 32, the emitters of the matrix of the display operate to emit pixels of light of the image 32 via the area 31 of the luminaire output 131*o*. Other emitters of the matrix of the display are OFF, in this example. Concurrently with such output of light of the image 32, the illumination emitters of the matrix of the illumination light source that correspond to and would otherwise output light via the area 31 displaying the image 32 are OFF (not shown in the drawing). However, the appropriate illumination emitters 25 along other parts of the luminaire output 131*o* are turned ON to provide a suitable amount of general illumination light output.

With this strategy, the methodology might include a step of selecting a portion 31 but not all of the luminaire output for output of the image 32, for example as part of the image presentation format in step S2 of the method 10 of FIG. 1. In the example of FIG. 3, the step S4 (FIG. 1) of operating the first light emission matrix limits emission of the output light of the image to the portion 31 of the luminaire output 131*o* selected for output of the image 32.

The size and location of the area 31 are variable, within the range of capabilities of the display and may be based on aspects of the image, user input, etc. FIG. 3 shows a rectangular image extending across the entire width (horizontal dimension) of the luminaire output 131*o* but only extending partially across the height (vertical dimension) of the luminaire output 131*o*. Although the image output area 31 may be closer to or extend to the top or bottom edge of the luminaire output 131*o*, in the example, the image output area 31 is approximately centered vertically on the luminaire output 131*o*. As a result, there are similarly sized portions in the form of bands bars 33*t* and 33*b* at the top and bottom of luminaire output 131*o* that are not outputting any light of the image 32.

For this strategy (FIG. 3), the area of the luminaire output selected for emission of general illumination light in step S7 of the method 10 of FIG. 1 is one, the other or both of the areas 33*t*, 33*b*. Those areas of the luminaire output 131*o* are outside the portion 31 of the luminaire output 131*o* selected for output of the image 32. Then, the unselected portions of the second light emission matrix, where the LEDs or other type of general illumination light emitters are not operating to emit light, correspond to the portion 31 of the luminaire output 131*o* selected for output of the image 32.

To summarize, the emitters of the first emission matrix of the display operate to emit light of the image, only in portions of that first matrix where the emissions are output via area 31. The emitters of the first emission matrix of the display that could otherwise output light via areas 33*t*, 33*b*, are turned OFF and do not emit light of the image at this time. Concurrently, a number of the LED emitters 25 of the second emission matrix selected among those aligned with sub-areas 27 in bands 33*t* or 33*b* operate to output general illumination light. However, the emitters of the second emission matrix of the general illumination light source that otherwise would output light through the image display area 31 are turned OFF so as to not interfere with the light output of the image 32.

Although not shown in the example, the display matrix emitters that correspond to the selected illumination areas 33*t*, 33*b* of the luminaire output 131*o* could operate but not in a manner to output light of pixels of the image. In this alternative operation, the image 32 is still only output in area 31. Display emitters at pixel points of the first emission matrix corresponding to output areas 33*t*, 33*b* could be operated so as to contribute to the general illumination light output, for example, to increase illumination light intensity and/or to mix with and thereby adjust the color characteristic of the illumination light output from the LEDS 25 operating in the output areas 33*t*, 33*b*.

Much like the earlier example of FIG. 2, the LEDs 25 in selected portions of the emission matrix of the illumination light source that emit through areas 27 within the areas 33*t*, 33*b* of the luminaire output 131*o* operate concurrently with the image display output to provide white general illumination light. There may be some interference of the illumination light along edges of the image 32, dependent on factors such as intensity of the illumination light output and intensity of the display light output. The image 32 will be subject to less interference, however, in portions of the area 31 approaching the middle (along the vertical dimension in the illustrated orientation) of the image display area 31. The illustrated interference mitigation strategy, however, should sufficiently mitigate undue interference so as to allow a human observer to perceive and understand the content of the image 32 from the display output while the luminaire is concurrently outputting the general illumination light.

These two strategies may be combined, and other interference mitigation strategies may be implemented alone or combination with one or both of the specific examples.

Figure 4:
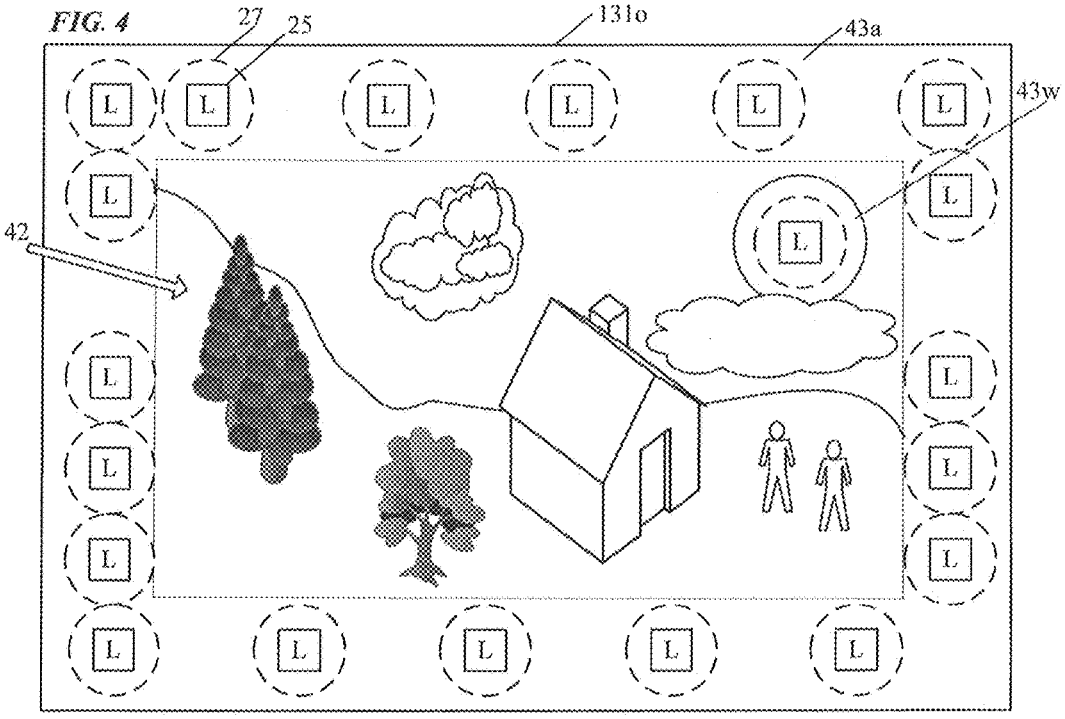

FIG. 4 represents an output of light of an image 42 in a selected image output area 41. In the example of FIG. 4, the rectangular image output area 41 is somewhat smaller and shaped to provide bands or bars without image light on the sides of the area 41 as well as along the top and bottom of the image output area 41. Generally, the area 41 is selected and the display is controlled to output light of the image 42 in area 41 but not in area 43*a*, essentially the same as in the example of FIG. 3 described above. Illumination emitter LEDs 25 output illumination light via the area 43*a*, and operate essentially the same as in the example of FIG. 3 described above.

The example of FIG. 4, however, also includes some illumination light output utilizing the strategy discussed above with regard to FIG. 2. In this example, the image 42 includes an area 43*w* that may be output from the display as white light. The example depicts a white output white area 43*w* within the image 42 in the shape of the sun. In addition to operating LEDs 25 to output illumination light via the area 43*a*, the white area 43*w* is identified and one or more LEDs corresponding to that area are operated to output illumination light via the area 43*w*, essentially as in the example of FIG. 2.

The image light output area like 43*w* where the emitting LEDs 25 are operational, however, need not always be a white image light output area. That image area may provide some other image light output color that is not as susceptible to disruptive interference by the illumination light output from the co-located illumination emitter LED(s) 25. The area 43*w*, for example, might be a relatively bright color, such as yellow. In the illustrated example where area 43*w* presents an image of the sun, the image light output could be an adjusted sunlight color, such as a warm white or even somewhat orange representation of light at sunset, particularly if the color temperature of the co-located illumination emitter(s) may be adjusted to a somewhat corresponding light color for the sunlight.

Figure 5:
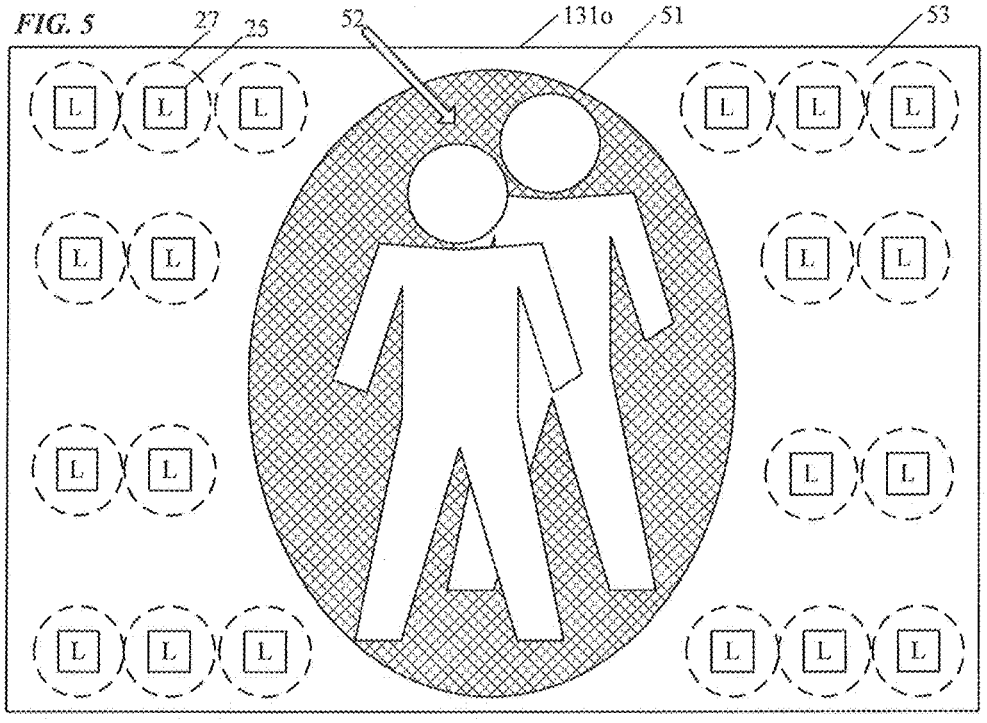

FIG. 5 illustrates a mitigation strategy that operates essentially the same as the approach illustrated in FIG. 3, with a particular area 51 providing output of the light of the image 52, while illumination light from emitters 25 is output via areas 27 within non-image area 53. In this example, the output image 52 is cropped in a particular manner, e.g. an oval vignette, and the area 53 for illumination light output has a corresponding shape around the image area 51. The shape may be somewhat arbitrary or the shape may follow an object within the image, e.g. to correspond to the shape of a person, the face of a person or some other object of particular interest in the image.

Figure 6:
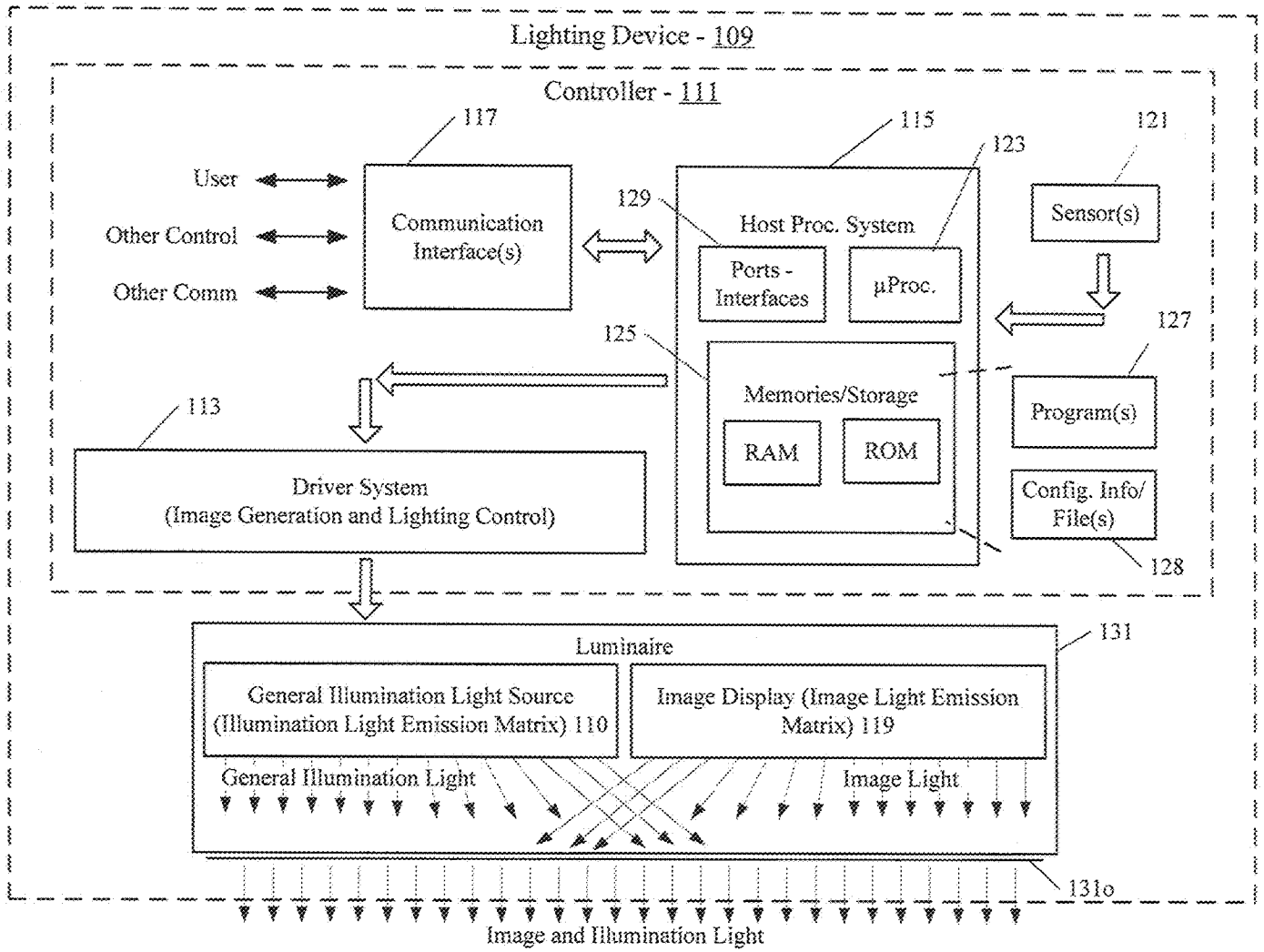
FIG. 6 is a high level functional block diagram of a lighting device that includes a luminaire that may support concurrent display image light output and illumination light output, where the control element(s) of the lighting device are configured to implement one or more of the interference mitigation strategies.

FIG. 6 illustrates an example of a luminaire 131 as part of a lighting device 109 that also includes a controller 111. In the simplified block diagram example, the luminaire 131 includes a controllable general illumination light source 110, which includes a light emission matrix. The source 110 is configured to output illumination light from that light emission matrix via the luminaire output 131*o*. The luminaire 131 also includes a display 119, which includes a light emission matrix configured to output light from selected areas of that light emission matrix, through the luminaire output 131*o*, as a representation of an image. Display 119 is an emissive type display device controllable to emit light of a selected image, e.g. as a still image or a video frame. In most examples, the luminaire 131 includes two relatively separate and distinct emission matrices, although there may be additional emission matrices, or the emission matrices functionalities thereof may be combined into one physical matrix of suitable emitters. In the example with two physical matrices, for the general illumination light source and the display, the matrices are co-located such that an available output region of the illumination light emission matrix at least substantially overlaps an available output region of the display light emission matrix, as generally represented by overlapping emission arrows from the source 110 and the display 119 and by the arrows for combined light output from the luminaire output 131*o*.

The display 119 may be either a commercial-off-the-shelf image display type device or an enhanced display or the like specifically adapted for use in the luminaire 131. The image display 119 is configured to output light to present an image. The presented image may be a real scene, a computer generated scene, a single color, a collage of colors, a video stream, animation or the like. The emission matrix of the illumination light source 110 may be an otherwise standard general illumination system, of multiple individually controllable emitters. Several examples of the luminaire 131 in which the lighting device and/or the display are specifically configured for use together in a luminaire are discussed later.

The general illumination light from source 110 alone or in combination with light output from the display 119 illuminates a space, for example, in compliance with governmental building codes and/or industry lighting standards. The illumination light source 110 may have a maximum light generation capability at least at an intensity of 200 lumens. For general lighting examples, lumen outputs of the luminaire 131 may range from 200 to 1600 lumens for typical office or residential applications. Higher lumen outputs may be desirable for commercial or industrial general illumination. These represent examples only of possible maximum output intensities for general illumination, and the source 110 is controllable to provide lower intensity outputs, e.g. for dimming.

To implement the interference mitigation strategy, the emission matrix of the general illumination light source 110 will have sufficient emitters (e.g. of number and lumen output capabilities) to achieve levels of expected lumen output levels corresponding to specified intensity settings with some of the emitters of that matrix OFF or operating at low intensity. In that sense, for concurrent operation of both the display 110 and the illumination light source 110, the emission matrix of the illumination light source 110 will have some excess capacity. For higher intensity settings, the luminaire 131 may run an illumination only mode, in which with all of the emitters of the emission matrix of the general illumination light source 110 operate. In that mode, some or all of the emitters of the emission matrix of the display 119 may concurrently operate in a non-display mode, e.g. white output only to further increase the output intensity of light from the luminaire output 131*o* or selected color/intensity to tune the color of the light from the luminaire output 131*o* by mixing with light from the source 110.

The lighting device 109 also includes a driver system 113 coupled to control light outputs generated by the first and second light emission matrices in the source 110 and the display 119. Although the driver system 109 may be separately located, in the example, the driver system 113 is implemented as an element of the controller 111. The driver system 113 may be implemented as an integrated driver circuit, although in many cases, the system 113 will include two separate driver circuits, one specifically adapted to provide suitable drive signals to the emitters of the particular implementation of the emission matrix of the general illumination light source 110 and another specifically adapted to provide suitable drive signals to the emitters of the emission matrix of the display 119. Although active-matrix driver circuitry may be used in the driver system 113, to drive one or both of the emission matrices, driver circuitry may, passive matrix driver circuitry may be used. For example, a passive matrix driver circuit may be a more cost effective solution to drive one or both of the emission matrices, particularly for any emission matrix that need not be dynamically controlled at a fast refresh rate. An issue with passive matrix is that the brightness scales with the number of rows in the emission matrix. It may be acceptable for a display but may not be acceptable for general illumination light source. Both active matrix and passive matrix can independently control pixel outputs, and thus they are the two main methods to create images for display. Either of these two methods may be used for driver circuitry for the image display 119. For a driver circuit for the emission matrix of the general illumination light source 110, active matrix or passive matrix driving methods may not be required. For example, is some configurations of the source 110, general illumination light emitters are arranged together in a group forming a controllable row or a controllable column. Driving such a matrix then involves controlling a series of lighting emitters together instead of one emitter at each row and column intersection. In this later case, conventional pulse-width modulation driving circuitry can tune the light intensity for a series of illumination lighting "pixels." This driving method is more energy efficient and more cost effective than current implementations of active matrix or passive matrix. In any event, the controllable luminaire 131 provides general illumination light output from the light source 110 in response to lighting control signals received from the driver system 113. Similarly, the controllable luminaire 131 provides image light output from the display 119 in response to image control signals received from the driver system 113.

As shown in FIG. 6, the controller 111 also includes a host processor system 115 coupled to control operation of the driver system 113, and through the driver system 113 to control illumination and image light output from the luminaire 131. The controller 111 may also include one or more communication interfaces 117 and/or one or more sensors 121. Other circuitry may be used in place of the processor based host system 115 (e.g. a purpose built logic circuit or an ASIC). In the illustrated example, the driver system 113 together with higher layer control elements of the device, such as the host processor system 115, serve as means for controlling the one or more matrices of light emitters to mitigate interference of illumination light output with concurrently emitted light of the image. With advances in circuit design, driver circuitry could be incorporated together with circuitry of the host processor system.

FIG. 6 also provides an example of an implementation of the high layer logic and communications elements to control luminaire operations. As shown in FIG. 6, the example 111 of the controller includes the host processor system 115, one or more sensors 121 and one or more communication interface(s) 117. Other implementations of the circuitry of the controller 111 may be utilized.

The circuitry of the controller 111 may be configured to operate the illumination light source 110 to generate the illumination light at least during an illumination state of the luminaire 131, and to operate the display 119 to emit the light of the image at least during an image display state of the luminaire 131. Although these illumination and display states could occur separately, e.g. at non-overlapping times, the interference mitigation strategies under discussion here are applicable to states in which the luminaire 131 produces both types of light concurrently for simultaneous output at 131*o*.

In the example of FIG. 6, the host processor system 115 provides the high level logic or "brain" of the controller 111 and thus of the lighting device 109. In the example, the host processor system 115 includes memories/storage 125, such as a random access memory and/or a read-only memory, as well as programs 127 stored in one or more of the memories/storage 125. The programming 127, in one example, configures the lighting device 109 to implement display and illumination via the controlled luminaire 131 with an interference mitigation strategy, as outlined above.

At a high level, the host processor system 115 is configured to operate the general illumination light source 110 and the display 119 via the driver system 113 to implement functions, including illumination and image output functions which also involve interface mitigation. For example, the first light emission matrix is operated so that the display 119 outputs the light of the image via an output 131*o* of the luminaire 131. Based on a characteristic of the image output, the host processor system 115 selects an area of the output 131*o* of the luminaire 131 where general illumination light output from the second light emission matrix (of the source 110) will not unduly interfere with the output light of the image by the first light emission matrix. While the first light emission matrix is emitting the light of the image, the luminaire 131 operates a portion of the second light emission matrix of the source 110, corresponding to the selected area of the luminaire output 131*o*, to emit the general illumination light via the selected area of the luminaire output 131*o*. Concurrently all unselected portions of the second light emission matrix of the source 110, are not selected and emitters in those portions do not operate.

More specifically, the host processor system 115 controls operation of the luminaire 131 based on image data and a general illumination light setting, which may be stored in memory 125 in the controller 111 or received as streaming data for temporary storage (buffering in local memory). Operation also is controlled, based on programming of the host processor system 115 and/or appropriate illumination source control data, to implement one or a combination of the interference mitigation strategies as discussed herein.

Hence, the memories/storage 125 may also store various data, including luminaire configuration information 128 or one or more configuration files containing such information (e.g. an image, illumination setting data, communication configuration or other provisioning data, or the like) in addition to the illustrated programming 127. Light source control data may be generated or adjusted to implement an interference mitigation strategy. The relevant data may be generated remotely at a server or the like and implemented in the illumination setting data streamed or downloaded to the controller 111. Alternatively, the analysis of the image and associated control of the source 110 to mitigate interference may be implemented by the host processor system 115, based on appropriate programming 127 in memory 125.

Thus, programming or control data used by the host processing system 115 is configured to implement control of operation of a general illumination light source 110 of the luminaire 131 when outputting general illumination light responsive to a received or stored setting while a display 119 of the luminaire 131 is concurrently outputting light of an image based on received or stored image data. The control operation mitigates interference of the illumination light output with aspects of the displayed image light output, e.g. to implement one of the mitigation strategies in the examples discussed above relative to FIGS. 1-5.

The host processor system 115 includes a central processing unit (CPU), shown by way of example as a microprocessor (μP) 123, although other processor hardware may serve as the CPU. The CPU and memories, for example, may be implemented by a suitable system-on-a-chip often referred to as a micro-control unit (MCU). In a microprocessor implementation, the microprocessor may be based on any known or available microprocessor architecture, such as a Reduced Instruction Set Computing (RISC) using ARM architecture, as commonly used today in mobile devices and other portable electronic devices. Of course, other microprocessor circuitry may be used to form the processor 123 of the controller 111. The processor 123 may include one or more cores. Although the illustrated example includes only one microprocessor 123, for convenience, a controller 111 may use a multi-processor architecture.

The ports and/or interfaces 129 couple the processor 123 to various elements of the lighting device 109 logically outside the host processor system 115, such as the driver system 113, the communication interface(s) 117 and the sensor(s) 121. For example, the processor 123 by accessing programming 127 in the memory 125 controls operation of the driver system 113 and thus operations of the luminaire 131 via one or more of the ports and/or interfaces 129. In a similar fashion, one or more of the ports and/or interfaces 129 enable the processor 123 of the host processor system 115 to use and communicate externally via the interface(s) 117; and one or more of the ports 129 enable the processor 123 of the host processor system 115 to receive data regarding any condition detected by a sensor 121, for further processing.

In the operational examples, based on its programming 127, the processor 123 processes data retrieved from the memory 123 and/or other data storage, and responds to illumination setting parameters in the retrieved configuration data 128 to control the light generation by the source 110. The light output control also may be responsive to sensor data from a sensor 126. The light output parameters may include either one or both of light intensity and light color characteristics of the light from source 110, either for overall light generated by the source 110 or a sub-groups of one or more emitters, among the matrix of emitters of the source 110. The illumination light setting parameters may also control modulation of the light output, e.g. to carry information on the illumination light output of the luminaire 131 and/or to spatially modulate illumination light output distribution (if the luminaire 131 includes an optical modulator, not shown). The configuration file(s) 128 may also provide the image data, which the host processor system 115 uses to control the display driver and thus the light emission from the image display 119.

In the examples of FIGS. 1-5, the lighting device 109 operates a selected number but not all of the emitters of the second emission matrix of the general illumination light source 110; and the emitters operated to produce the general light output through selected areas of the luminaire output are selected so as to mitigate interference of the illumination light output with aspects of the displayed image light output. As noted in the discussion of steps such as S1 and S8 of the method 10 of FIG. 1, the lighting device 109 is capable of controlling operation of the general illumination light source 110 so that the light output of the luminaire 131 satisfies a determined operating parameter, e.g. a parameter included in the setting data obtained in step S1. In some cases, the lighting device 109 operates a selected number but not all of the emitters of the first emission matrix of the display 119, for example, to output light of the image through some but not all of the area of the luminaire output 131*o*.

As noted, the host processor system 115 is coupled to the communication interface(s) 117. In the example, the communication interface(s) 117 offer a user interface function or communication with hardware elements providing a user interface for the lighting device 109. The communication interface(s) 117 may communicate with other control elements, for example, a host computer of a building control and automation system (BCAS). The communication interface(s) 117 may also support device communication with a variety of other equipment of other parties having access to the lighting device 109 in an overall/networked lighting system encompassing a number of lighting devices 109, e.g. for access to each lighting device 109 by equipment of a manufacturer for maintenance or access to an on-line server for downloading of programming instruction or configuration data for setting aspects of luminaire operation.

In an example of the operation of the lighting device 109, the processor 123 receives a configuration file 128 via one or more of the communication interfaces 117. The processor 123 may store, or cache, the received configuration file 128 in storage/memories 125. The file may include image data, or the processor 123 may receive separate image data via one or more of the communication interfaces 117. The image data may be stored, as part of or along with the received configuration file 128, in storage/memories 125. Alternatively, image data (e.g. video) and/or general illumination light setting data may be received as streaming data and used to drive the display 119 in real-time.

The driver system 113 may deliver the image data directly to the image display 119 for presentation or may convert the image data into a signal or data format suitable for delivery to the image display 119. For example, the image data may be video data formatted according to compression formats, such as H. 264 (MPEG-4 Part 10), HEVC, Theora, Dirac, RealVideo RV40, VP8, VP9, or the like, and still image data may be formatted according to compression formats such as Portable Network Group (PNG), Joint Photographic Experts Group (JPEG), Tagged Image File Format (TIFF) or exchangeable image file format (Exif) or the like. For example, if floating point precision is needed, options are available, such as OpenEXR, to store 32-bit linear values. In addition, the hypertext transfer protocol (HTTP), which supports compression as a protocol level feature, may also be used. For at least some versions of the display 119 offering a low resolution image output, higher resolution source image data may be down-converted to a lower resolution format, either by the host processor system 115 or by processing in the circuitry of the driver system 113.

For illumination control, the configuration information in the file 128 may specify operational parameters of the controllable lighting device 109, such as light intensity, light color characteristic, and the like for light from the source 119. The results of the interference mitigation strategy, e.g. which emitters of the matrix of the source 110 are operating and which are not for a given image output by display 119, may be determined by the processor 123 or may be received as control data from another source/system/computer. The processor 123 by accessing programming 127 and using software configuration information 128, from the storage/memories 125, controls operation of the driver system 113, and through that driver system 113 controls the illumination light source 110, e.g. to achieve a predetermined illumination light output intensity and/or color characteristic for a general illumination application of the luminaire 131, including appropriate selections of output areas and operational states of emitters corresponding to those areas as discussed earlier.

A software configurable lighting device such as device 109 may be reconfigured, e.g. to change the image display output and/or to change one or more parameters of the illumination light output, by changing the corresponding aspect(s) of the configuration data file 128, by replacing the configuration data file 128, or by selecting a different file from among a number of such files already stored in the data storage/memories 125.

In other examples, the lighting device 109 may be programmed to transmit information on the light output from the luminaire 131. Examples of information that the lighting device 109 may transmit in this way include a code, e.g. to identify the luminaire 131 and/or the lighting device 109 or to identify the luminaire location. Alternatively or in addition, the light output from the luminaire 131 may carry downstream transmission of communication signaling and/or user data. The information or data transmission may involve adjusting or modulating parameters (e.g. intensity, color characteristic, distribution, or the like) of the illumination light output of the source 110 or an aspect of the light output from the display 119. Transmission from the display 119 may involve modulation of the backlighting of the particular type of display. Another approach to light based data transmission from the display 119 may involve inclusion of a code representing data in a portion of a displayed image, e.g. by modulating individual emitter outputs. The modulation or image coding typically would not be readily apparent to a person in the illuminated area who may observe the luminaire operations but would be detectable by an appropriate receiver. The information transmitted and the modulation or image codding technique may be defined/controlled by configuration data or the like in the memories/storage 125. Alternatively, user data may be received via one of the interfaces 117 and processed in the controller 111 to transmit such received user data via light output from the luminaire 131.

Apparatuses implementing functions like those of configurable lighting device 109 may take various forms. In some examples, some components attributed to the lighting device 109 may be separated from the source 110 and the image display 119 in the luminaire 131. For example, a lighting device 109 may have all of the above hardware components on or within a single hardware platform as shown in FIG. 6 or in different somewhat separate units. In a particular example, one set of the hardware components may be separated from one or more instances of the controllable luminaire 131, e.g. such that one host processor system 115 may control several luminaires 131 each at a somewhat separate location wherein one or more of the controlled luminaires 131 are at a location remote from the one host processor system 115. In such an example, a driver system 113 may be located near or included in a combined platform with each luminaire 131. For example, one set of intelligent components, such as the microprocessor 123, may control/drive some number of driver systems 113 and associated controllable luminaires 131. Alternatively, there may be one overall driver system 113 located at or near the host processor system 115 for driving some number of luminaires 131. It also is envisioned that some lighting devices may not include or be coupled to all of the illustrated elements, such as the sensor(s) 121 and the communication interface(s) 117. For convenience, further discussion of the lighting device 109 of FIG. 6 will assume an intelligent implementation of the lighting device 109 that includes at least the illustrated components.

In addition, the luminaire 131 is not size restricted. For example, each luminaire 131 may be of a standard size, e.g. 2-feet by 2-feet (2×2), 2-feet by 4-feet (2×4), or the like, and arranged like tiles for larger area coverage. Alternatively, one luminaire 131 may be a larger area device that covers a wall, a part of a wall, part of a ceiling, an entire ceiling, or some combination of portions or all of a ceiling and wall.

Figure 7A:
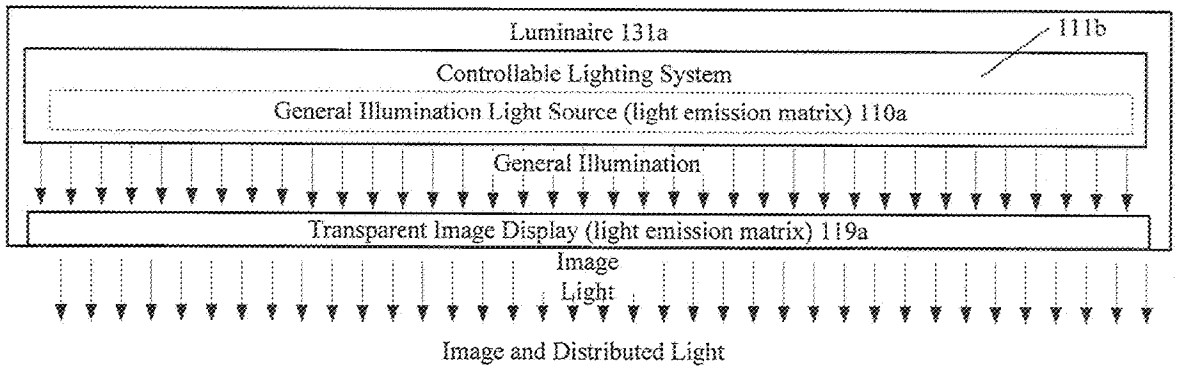
FIG. 7A to 7C are functional block diagrams of different examples of the luminaire in the device of FIG. 6, which may support concurrent display image light output and illumination light output.
Figure 7B:
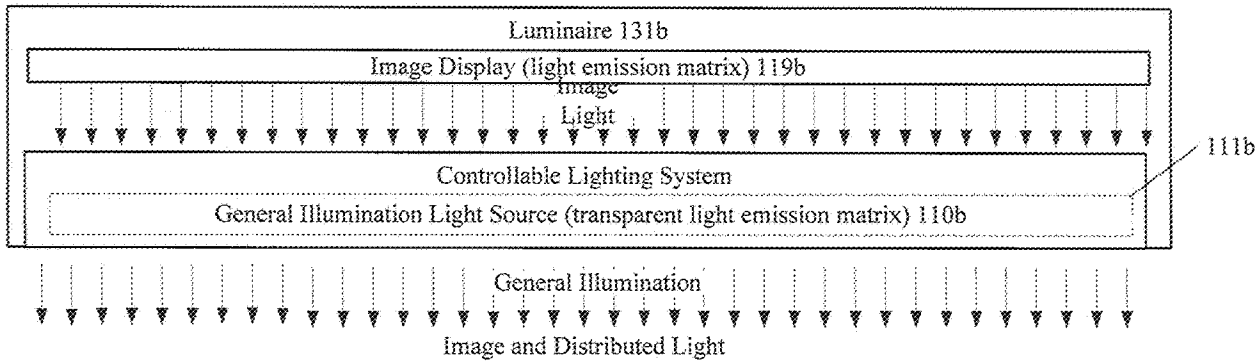
Figure 7C:
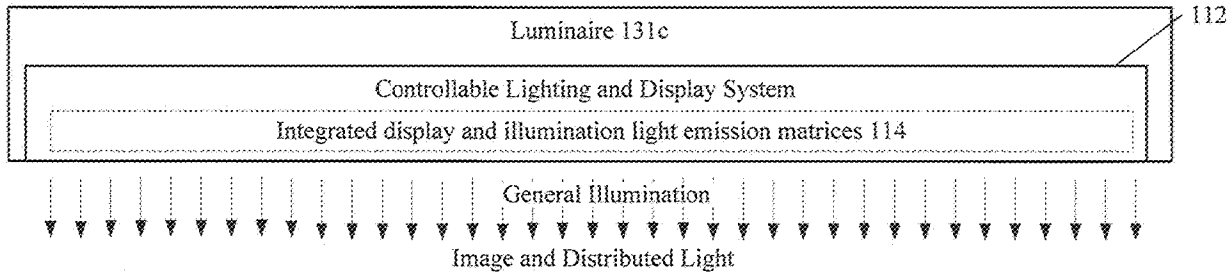

Lighting equipment like that disclosed the example of FIG. 6, may be used with various implementations of the luminaire 131. Although several examples of luminaire implementations have been briefly discussed above, it may be helpful to consider some examples in more detail. FIGS. 7A to 7C provide high level functional illustrations of several general categories of the various luminaire implementations.

In FIG. 7A, the luminaire 131*a* utilizes a transparent implementation of the display 119*a*, and illumination light from the general illumination light source 110 passes through and is combined with the image output light from the display 119*a*. At a high level, the controllable luminaire 111*a* provides general illumination lighting via general illumination source 110. The general illumination light source 110 is configurable with respect to light intensity. The light from the source 110 typically is white. The color characteristic(s) of the light from the source 110 also may be controllable. The general illumination light source 110 may include or be coupled to output the illumination light via an optical spatial modulator (not shown).

The transparent image display 119*a* may be either a commercial-off-the-shelf image display device or an enhanced transparent image display device that allows general illumination lighting generated by general illumination light source 110*a* to pass through. The general illumination lighting alone or in combination with light output from the display illuminates a space in compliance with governmental building codes and/or industry lighting standards. The illumination light source, for example, may support lumen output levels of 200 lumens or higher, with selective dimming capabilities. The image display 119*a* is configured to present an image. The presented image may be a real scene, a computer generated scene, a single color, a collage of colors, a video stream, or the like.

Examples of transparent displays suitable for application in software configurable lighting devices or luminaires, which use light emission matrices to emit output light of images, are disclosed U.S. patent application Ser. No. 15/198,712, filed Jun. 30, 2016, entitled "enhancements of a Transparent Display to Form a Software Configurable Luminaire;" U.S. patent application Ser. No. 15/211,272, filed Jul. 15, 2016, entitled "Multi-Processor System and Operations to Drive Display and Lighting Functions of a Software Configurable Luminaire;" U.S. patent application Ser. No. 15/467,333 filed Mar. 23, 2017, entitled "Simultaneous Display and Lighting;" U.S. patent application Ser. No. 15/468,626, filed Mar. 24, 2017 entitled "Simultaneous Wide Lighting Distribution and Display;" and U.S. patent application Ser. No. 15/095,192, filed Apr. 11, 2016, entitled "Luminaire Utilizing a Transparent Organic Light Emitting Device Display," the entire contents all of which are incorporated herein by reference. These incorporated applications also disclose a variety of implementations of a general illumination light source including a second light emission matrix co-located the with an emission matrix of a transparent display.

The present teachings also apply to luminaires in which the general illumination light source, with the second emission matrix, is transparent with respect to light from the matrix of the display. FIG. 7B is a high level block diagram illustration of an example of this approach. In such an implementation 131*b* of the luminaire, the second emission matrix may include a transparent emitter matrix of LEDs, OLEDs, etc. similar to any of the examples of the display emission matrix discussed above, to implement the general Illumination light source 110*b*. The second emission matrix of the general illumination light source may use a different number of emitters with different spacing between emitters and/or a different type of (e.g. higher intensity and/or different color, output distribution, etc.) specifically tailored to support the general illumination application of the light provided by the general illumination light source 110*b*. Although not shown, an optical spatial modulator (or array of modulator cells) may be provided in association with the source 110*b*.

The luminaire 131*b* also includes a display 119*b*, including a suitable image light generation matrix. The display 119*b* may be an off-the-shelf display.

Figure 9:
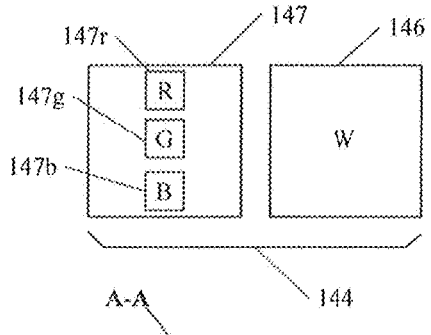
FIG. 9 is an enlarged view of a section of the LED board of the device of FIG. 8, corresponding to the dashed circle A-A in FIG. 8.

The present teachings also encompass luminaire implementations 131*c* (FIG. 7C) in which a controllable lighting and display system 112 incorporates functions/emitters of the two matrices together at 114, for example on a single board. Although physically integrated, the emitters are logically operated as two independently controllable emission matrices (one for display and another for general illumination), including for the interference mitigation strategies discussed herein. Hence, the mitigation strategies may be implemented using the luminaire 131*c* with integrated emission matrices in a manner similar to the examples outlined so far. In view of the different in the arrangement of the source and display, it may be helpful to consider an example of an implementation of such an integrated lighting and display system, with respect to FIGS. 8-10.

Figure 8:
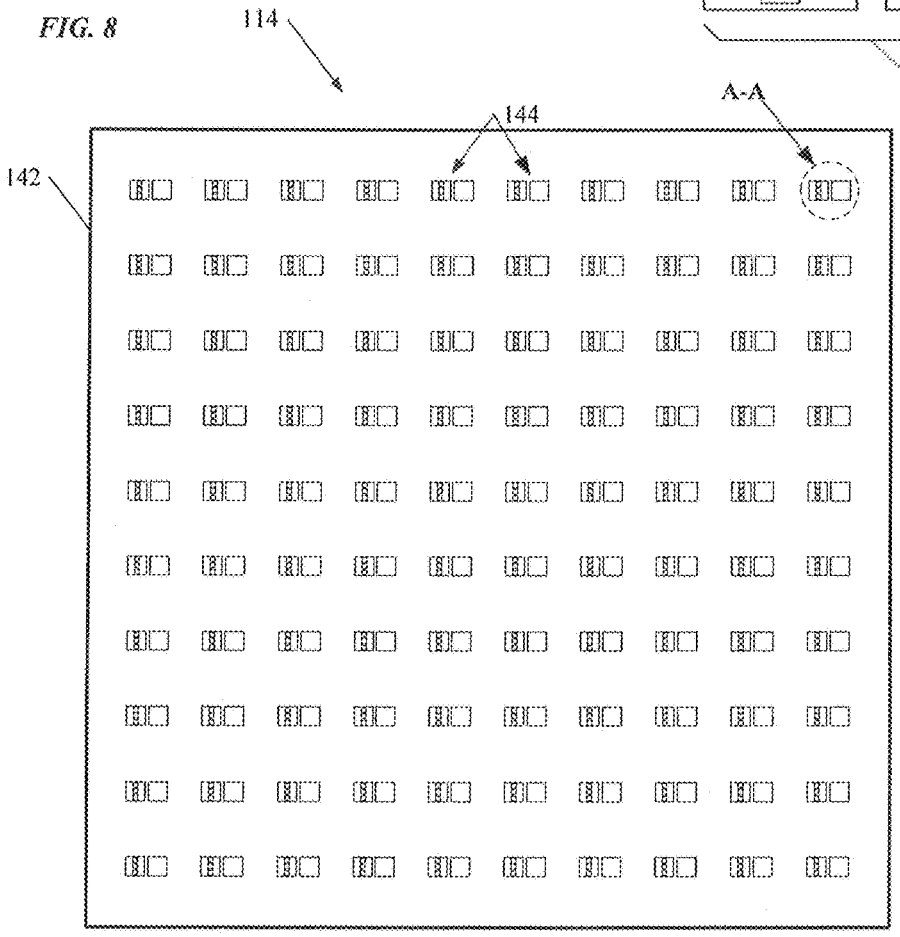
FIG. 8 is a plan view of a light emitting diode (LED) board layout including both a matrix of integral red (R), green (G), blue (B) LED devices for image display light generation and a matrix of higher intensity white (W) LEDs for generating controllable illumination light output for a general lighting application.

As shown in FIG. 8, the combined matrix 114 includes an appropriate circuit board 142. A combination of emitters 144 are mounted on the board 142 at each of a number of pixel emission points of the combined matrix 114. As shown in the enlarged example of FIG. 9, the emitters at each such point of the matrix include a white light emitter 146 for illumination light generation and a color and intensity controllable display emitter 147. In the example, the display emitter 146 includes a red emitter (R) 147*r*, a green emitter (G) 147*g* and a blue emitter (B) 147*b*, although additional or alternative color emitters may be provided. In examples, the emitters 146 and 147 may be LED devices. The white illumination light emitter 146 may be a LED of a type commonly used in LED based lighting equipment. The RGB display emitter 147 may be a combined device having the RGB emitters in the same package or on the same chip substrate. The white illumination light emitter 146 may be capable of an output intensity higher than any of the red emitter (R) 147*r*, the green emitter (G) 147*g* and the blue emitter (B) 147*b* and/or higher that the maximum output intensity of overall display emitter 147.

The present example also encompasses arrangements in which one emitter chip or package includes RGBW emitters if the white capability is sufficient for a lighting application. The white emitter 146 could be on the same chip or in the same package as the sub emitters of the display emitter 147. However, because of the higher intensity desired for illumination light generation, and thus the higher amount of generated heat, it may be better to provide the white illumination light emitter separately, as shown. Also, the display emitter 147 may have an output distribution optimized for the display function that is different from the output distribution of an emitter 146 optimized for the illumination function. To provide these distributions, however, corresponding optics may be added. If the display and illumination emitters are Lambertian or emitting in a wide angle, for example, additional space is used for these optics due to etendue limitation, which may limit how close the display and illumination emitters may be placed with respect to each other.

For purposes of the general illumination, display and interference mitigation strategies, the emitters 146 are controllable independently of the display through a suitable driver functionality implemented as part of the driver system 113 in the example of FIG. 6. The display emitters 147 and the components thereof are controllable independently of the illumination light source through a suitable driver functionality implemented as part of the driver system 113 in the example of FIG. 6. Although integrated into one matrix on the board 142, the emitters 146 and 147 therefore are logically two independent emission matrices for purposes of light generation and control. As a result, the logical matrices may be controlled in essentially the same ways as the matrices of the separate illumination light sources and displays in the earlier examples.

Figure 10:
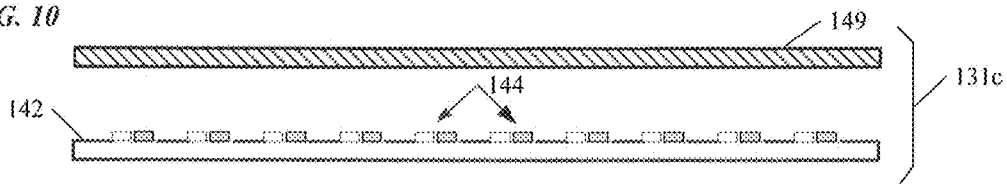
FIG. 10 is an end view of the device of FIG. 8 in combination with a diffuser.

FIG. 10 is a simplified cross-sectional view of a luminaire 131*c* incorporating the board 142 and combined/integrated matrix of emitters at pixel points 144. In addition, the luminaire 131*c* may include a diffuser 149, which helps to homogenize output light for both illumination and image display. As shown in the drawing example, the diffuser 149 may be a separate sheet or layer, e.g. of a suitable white translucent material, adjacent to or formed on output of the luminaire.

The example includes the diffuser 149, but the diffuser is optional. If not provided, the point sources of light, e.g. outputs from the LEDs 146, 147 at points 144, may be visible through the light luminaire output.

For illumination, the diffuser 149 diffuses the illumination light output, which improves uniformity of illumination light output intensity, as may be observed across the output through the luminaire and/or as the illumination light is distributed at a working distance from the luminaire 131*c* (e.g. across a floor or desktop).

For display, the diffuser 149 diffuses the image light from display emitters 147. For some types/resolutions of the display, some degree of diffusion may be tolerable or even helpful. Use of higher resolution data to drive a lower resolution implementation of the display may cause the image output to become pixelated. In some cases, the pixelation may prevent a person from perceiving the intended image on the display. Processing of the image data before application thereof to drive the pixel emitters 147 of the display and/or blurring of the output image by the diffuser 149 effectively blur discrete rectangles or dots of the pixelated image. Such blurring of the pixelated artifacts in the output image may increase an observer's ability to perceive or recognize a low resolution output image. An implementation of such a fuzzy pixels display approach in a system 109 (FIG. 6) with a luminaire such as 131*c* may be implemented by a combination of downsampling of the image data and use of the diffuser 149 over the image display output. A similar diffuser may be used in other luminaire examples. Additional processing of the image data in the digital domain, e.g. Fourier transformation and manipulation in the frequency domain, may be implemented to reduce impact of low resolution image output on some types of display devices.

Figure 11:
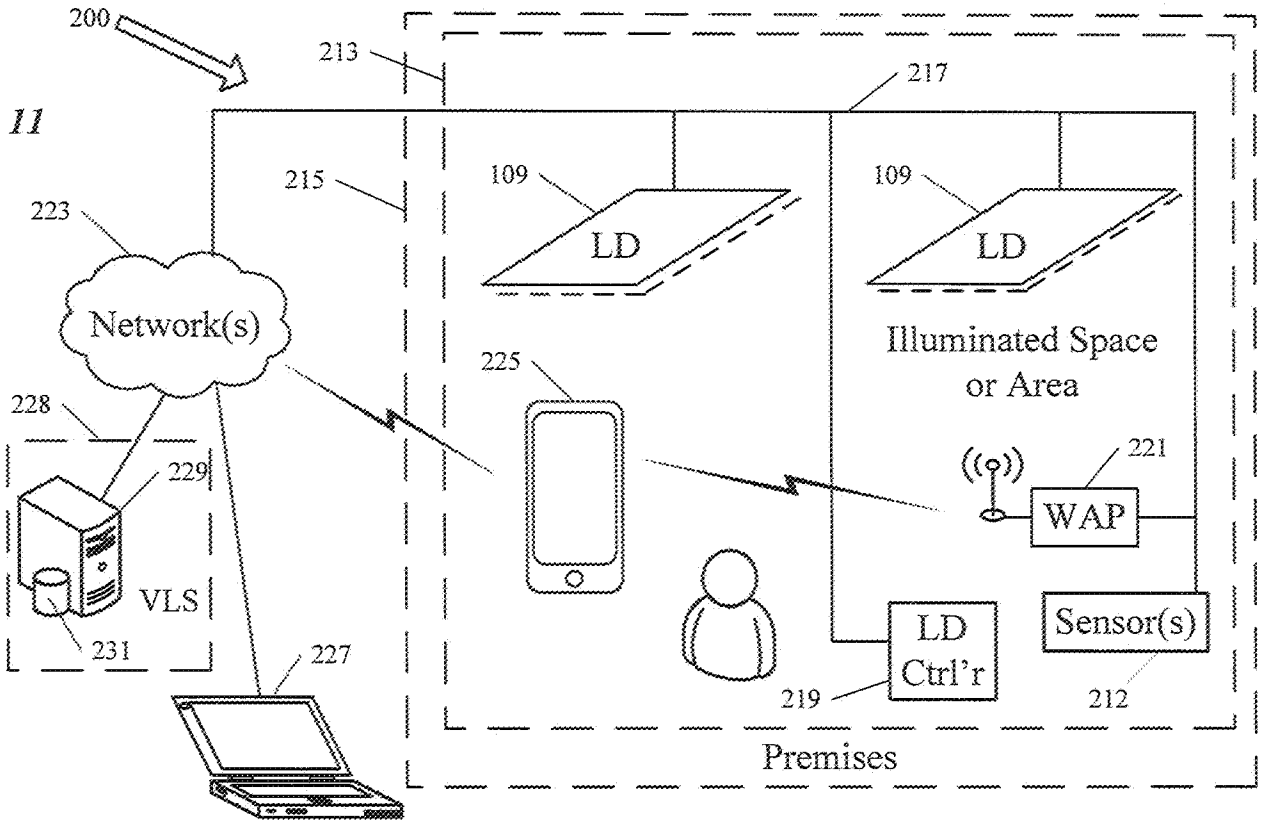
FIG. 11 is a high-level functional block diagram of a system including a number software configurable lighting devices that may display an image and provide general illumination.

It may be helpful to consider a high-level example of a system including software configurable lighting devices 109, with reference to FIG. 11. That drawing illustrates a lighting system 200 for providing configuration or setting information, e.g. based on a user selection, to at least one software configurable lighting device (LD) 109 of any of the types discussed herein, including devices 109 configured to implement one or more of the interference mitigation strategies. An appropriate interference mitigation strategy may be based on analysis of received configuration or setting information; or received configuration or setting information may have been adjusted or modified to include additional instructions to enable a lighting device 109 to implement the appropriate interference mitigation strategy.

The system example 200 shown in the drawing includes a number of such lighting devices (LD) 109. For purposes of discussion of FIG. 11, it is assumed that each software configurable lighting device 109 generally corresponds in structure to the block diagram illustration of a lighting device 109 in FIG. 6, with the illumination light source and display device structured/located to operate as a luminaire 131 as discussed in various other examples above. The example of the lighting system 200 in FIG. 11 also includes a number of other devices or equipment configured and coupled for communication with at least one of the software configurable lighting devices 109.

In the lighting system 200 FIG. 11, the software configurable lighting devices 109, as well as some other elements of system 200, are installed within a space or area 213 to be illuminated at a premises 215. The premises 215 may be any location or locations serviced for lighting and other purposes by such a system 200 of the type described herein. Lighting devices, such as lighting devices 109, that are installed to provide general illumination lighting in the premises 215 typically comply with governmental building codes (of the respective location of the premises 215) and/or lighting industry standards. Most of the examples discussed below focus on indoor building installations, for convenience, although the system may be readily adapted to outdoor lighting. Hence, the example of lighting system 200 provides configurable lighting (illumination and display) and possibly other services in a number of service areas in or associated with a building, such as various rooms, hallways, corridors or storage areas of a building and an outdoor area associated with a building. Any building forming or at the premises 215, for example, may be an individual or multi-resident dwelling or may provide space for one or more enterprises and/or any combination of residential and enterprise facilities. A premises 215 may include any number of such buildings, and in a multi-building scenario the premises may include outdoor spaces and lighting in areas between and around the buildings, e.g. in a campus (academic or business) configuration.

The system elements, in a system like lighting system 200 of FIG. 11, may include any number of software configurable lighting devices 109 as well as one or more lighting controllers 219. The lighting controller 219 may be an automated device for controlling lighting, e.g. based on timing conditions; and/or the lighting controller 219 may provide a user interface. Lighting controller 219 may be configured to provide control of lighting related operations (e.g., ON/OFF, intensity or brightness, color characteristic(s), etc.) of any one or more of the lighting devices 109. A lighting controller 219, for example, may take the form of a switch, a dimmer, or a smart control panel including a graphical, speech-based and/or touch-based user interface, depending on the functions to be controlled through device 219.

A lighting device 109 may include a sensor (as in FIG. 6). In the example, other system elements may also include one or more standalone implementations of sensors 212. Sensors, for example, may be used to control lighting functions in response to various detected conditions, such as occupancy or ambient light. Other examples of sensors include light or temperature feedback sensors that detect conditions of or produced by one or more of the lighting devices. If separately provided, the sensors may be implemented in intelligent standalone system elements such as shown at 212 in the drawing. Alternatively, sensors may be incorporated in one of the other system elements, such as one or more of the lighting devices 109 and/or the lighting controller 219.

The on-premises system elements 109, 212, 219, in a system like the system 200 of FIG. 11, are coupled to and communicate via a data network 217 at the premises 215. The data network 217 may be a wireless network, a cable network, a fiber network, a free-space optical network, etc.; although the example shows connection lines as may be used in a hard-wired or fiber type network implementation. The data network 217 in the example also includes a wireless access point (WAP) 221 to support communications of wireless equipment at the premises. For example, the WAP 221 and network 217 may enable a user terminal for a user to control operations of any lighting device 109 at the premises 213. Such a user terminal is depicted in FIG. 11, for example, as a mobile device 225 within premises 215, although any appropriate user terminal may be utilized. However, the ability to control operations of a lighting device 109 may not be limited to a user terminal accessing data network 217 via WAP 221 or other on-premises point of access to the network 217. Alternatively, or in addition, a user terminal such as laptop 227 located outside premises 215, for example, may provide the ability to control operations of one or more lighting devices 109 via one or more other networks 223 and the on-premises data network 217. Network(s) 223 may include, for example, a local area network (LAN), a metropolitan area network (MAN), a wide area network (WAN) or some other private or public network, such as the Internet.

Data network communications allow installation of configuration files or streaming of configuration instructions/data to the lighting devices 109 at the premises. Such data communications also may allow selection among installed configuration files in any lighting device 109 that stores more than one such file. In another example, a memory device, such as a secure digital (SD) card or flash drive, containing configuration data may be connected to one or more of the on-premises system elements 109, 212 or 219 in a system like system 200 of FIG. 11.

For lighting operations, the system elements (109, 212 and/or 219) for a given service area 213 are coupled together for network communication with each other through data communication media to form a portion of a physical data communication network. Similar elements in other service areas of the premises are coupled together for network communication with each other through data communication media to form one or more other portions of the physical data communication network at the premises 215. The various portions of the network in the service areas in turn are coupled together to form a data communication network at the premises, for example to form a LAN or the like, as generally represented by network 217 in FIG. 11. Such data communication media may be wired and/or wireless, e.g. cable or fiber Ethernet, Wi-Fi, Bluetooth, or cellular short range mesh. In many installations, there may be one overall data communication network 217 at the premises. However, for larger premises and/or premises that may actually encompass somewhat separate physical locations, the premises-wide network 217 may actually be built of somewhat separate but interconnected physical networks utilizing similar or different data communication media.

System 200 also includes server 229 and database 231 accessible to a processor of server 229. Although FIG. 11 depicts server 229 as located outside premises 215 and accessible via network(s) 223, this is only for simplicity and no such requirement exists. Alternatively, server 229 may be located within premises 215 and accessible via network 217. In still another alternative example, server 229 may be located within any one or more system element(s), such as lighting device 109, lighting controller 219 or sensor 212. Similarly, although FIG. 11 depicts database 231 as physically proximate server 229, this is only for simplicity and no such requirement exists. Instead, database 231 may be located physically disparate or otherwise separated from server 29 and logically accessible by server 29, for example via network 17.

Database 231 in this example is a collection of configuration information files for use in conjunction with one or more of software configurable lighting devices 109 in premises 215 and/or similar devices 109 of the same or other users in other areas or at other premises. The image and lighting configuration information may be combined into one configuration file for each overall luminaire output performance configuration or setting, or each image and each set of light configuration information may be in separate files. Data for implementing associated interference mitigation also may be included in configuration files with image and lighting control data or contained in other files in the database 231. For general illumination lighting, a setting or configuration file may specify intensity performance at various dimming levels and/or one or more color characteristics for general illumination; and such configuration information may include distribution settings for a lighting device luminaire 131 that also incorporates spatial optical modulation capabilities for the illumination light output. The general illumination lighting control data in the setting or configuration file may also specify aspects of interference mitigation, for example, particular general illumination LEDs 25 to operate (see FIGS. 2 to 5), and/or color or intensity of the LEDs 25 selected for operation.

The image data for use in driving the display may be in the same or a separate file. One option is to generate relevant control instructions for communication with the image data, for example, as part of or associated with the file containing the image data. For example, for a mitigation strategy like one of the examples shown in FIGS. 3 to 5, the data associated with the image data may specify one or more of size, shape or location of output of a particular image on the display (corresponding to a particular part of the area of the luminaire output 131*o*).

The software configurable lighting device 109 is configured to set illumination light generation parameters of the light source and possibly set modulation parameters for any spatial modulator in accordance with a selected configuration information file. For example, a selected configuration information file from the database 31 may enable a software configurable lighting device 109 to achieve a performance corresponding to a selected type or of existing hardware luminaire for a general illumination application or any other arbitrarily designed/selected general illumination performance. Thus, the combination of server 229 and database 231 may represent a "virtual luminaire store" (VLS) 228 or a repository of available configurations that enable a software configurable lighting device 109 to selectively function like any one of a number of real or imagined luminaires represented by the available illumination configurations.

It should be noted that the output performance parameters for general illumination need not always or precisely correspond optically to an emulated luminaire. For a catalog luminaire selection example, the light output parameters may represent those of one physical luminaire selected for its light characteristics whereas the distribution performance parameters (if the lighting device incorporates spatial optical modulation) may be those of a different physical luminaire or even an independently determined performance intended to achieve a desired illumination effect in area 213. The light distribution performance, for example, may conform to or approximate that of a physical luminaire or may be an artificial construct for a luminaire not ever built or offered for sale in the real world.

It should also be noted that, while various examples describe loading a single configuration information file onto a software configurable lighting device 109, this is only for simplicity. Lighting device 109 may receive one, two or more configuration information files and each received file may be stored within lighting device 109. In such a situation, a software configurable lighting device 109 may, at various times, operate in accordance with configuration information in any selected one of multiple stored files, e.g. operate in accordance with first configuration information during daylight hours and in accordance with second configuration information during nighttime hours or in accordance with different file selections from a user operator at different times for different intended uses of the space 213. Alternatively, a software configurable lighting device 109 may only store a single configuration information file. In this single file alternative situation, the software configurable lighting device 109 may still operate in accordance with various different configuration information, but only after receipt of a corresponding configuration information file which replaces any previously received file(s). In a further alternative, some or all of the relevant configuration information may be streamed to a lighting device more or less in real time.

Display images may be selected through the store 28 or obtained from other image sources.

Figure 14:
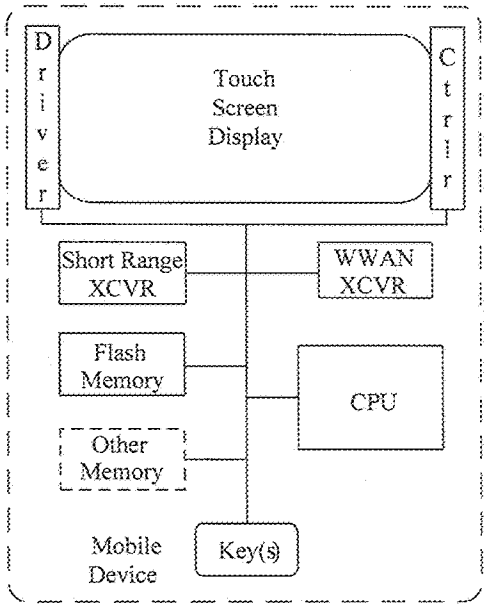
FIG. 14 is a simplified functional block diagram of a mobile device, as an alternate example of a user terminal device, for possible communication with a software configurable lighting device.
Figure 12:
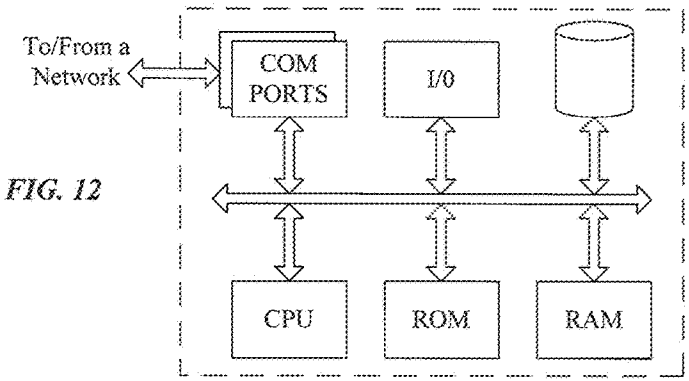
FIG. 12 is a simplified functional block diagram of a computer that may be configured as a host or server, for example, to supply communicate with a software configurable lighting device, such as that of FIG. 6, e.g., in a system like that of FIG. 11.
Figure 13:
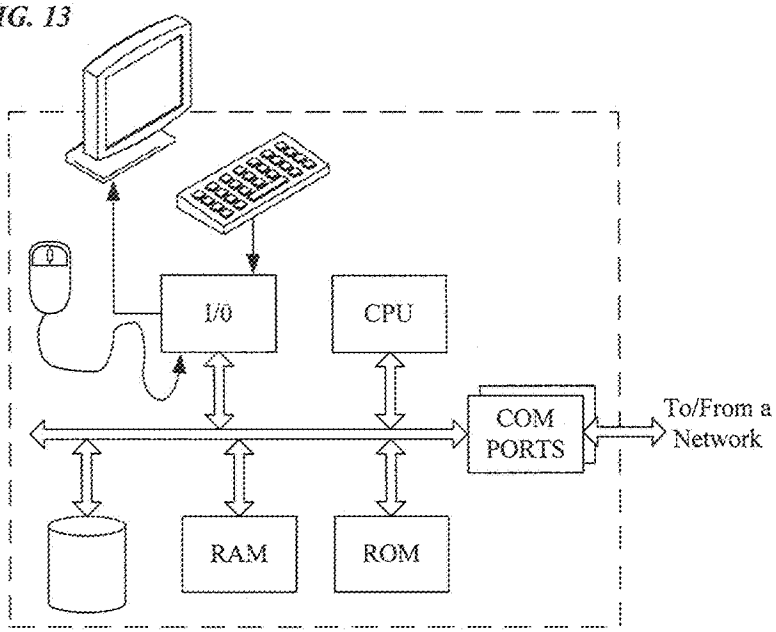
FIG. 13 is a simplified functional block diagram of a personal computer or other similar user terminal device, which may communicate with a software configurable lighting device.

As shown by the above discussion of FIG. 11, although many intelligent processing functions are implemented in lighting device, at least some functions may be implemented via communication with general purpose computers or other general purpose user terminal devices, although special purpose devices may be used. FIGS. 12 to 14 provide functional block diagram illustrations of exemplary general purpose hardware platforms that may be used in the system 200.

FIG. 12 illustrates a network or host computer platform, as may typically be used to generate, send and/or receive lighting control commands, configuration files and/or images and to access networks and devices external to the lighting device 109, for example, to implement the server 229 and/or the database 231 of the virtual luminaire store 228 of FIG. 11. FIG. 13 depicts a computer with user interface communication elements, such as terminal 227 as shown in FIG. 11, although the computer of FIG. 13 may also act as a server if appropriately programmed. The block diagram of a hardware platform of FIG. 14 represents an example of a mobile device, such as a tablet computer, smartphone or the like with a network interface to a wireless link, which may alternatively serve as a user terminal device for providing a user communication with a lighting device, such as device 109, or with a server. It is believed that those skilled in the art are familiar with the structure, programming and general operation of such computer equipment and as a result the drawings should be self-explanatory.

A server (see e.g. FIG. 12), for example, includes a data communication interface for packet data communication via the particular type of available network. The server also includes a central processing unit (CPU), in the form of one or more processors, for executing program instructions. The server platform typically includes an internal communication bus, program storage and data storage for various data files to be processed and/or communicated by the server, although the server often receives programming and data via network communications. In general, the hardware elements, operating systems and programming languages of such servers may be conventional in nature. Of course, the server functions may be implemented in a distributed fashion on a number of similar platforms, to distribute the processing load. A server, such as that shown in FIG. 12, may be accessible or have access to a lighting device 109 via the communication interfaces 117 of the lighting device 109. For example, the server may respond to a user request for an image and/or a configuration information file to send the requested information to a communication interface 117 of the lighting device 109. The information of a configuration information file may be used to configure a software configurable lighting device, such as lighting device 109, to set light output parameters comprising: (1) light intensity, (2) light color characteristic, (3) spatial modulation, or (4) image display in accordance with the received information. The received information may be used at the lighting device to implement an interference mitigation strategy of the type described above relative to FIGS. 1 to 5; or the analysis steps may be performed in advance at the server or another computer, in which case, the received information may provide illumination setting data and possibly display control data to implement a particular interference mitigation strategy.

A computer type user terminal device, such as a desktop or laptop type personal computer (PC), similarly includes a data communication interface CPU, main memory (such as a random access memory (RAM)) and one or more disc drives or other mass storage devices for storing user data and the various executable programs (see FIG. 13). A mobile device (see FIG. 14) type user terminal may include similar elements, but will typically use smaller components that also require less power, to facilitate implementation in a portable form factor. The example of FIG. 14 includes a wireless wide area network (WWAN) transceiver (XCVR) such as a 3G or 4G cellular network transceiver as well as a short range wireless transceiver such as a Bluetooth and/or WiFi transceiver for wireless local area network (WLAN) communication. The computer hardware platform of FIG. 12 and the terminal computer platform of FIG. 13 are shown by way of example as using a RAM type main memory and a hard disk drive for mass storage of data and programming, whereas the mobile device of FIG. 14 includes a flash memory and may include other miniature memory devices. It may be noted, however, that more modern computer architectures, particularly for portable usage, are equipped with semiconductor memory only.

The various types of user terminal devices will also include various user input and output elements. A computer, for example, may include a keyboard and a cursor control/selection device such as a mouse, trackball, joystick or touchpad; and a display for visual outputs (see FIG. 13). The mobile device example in FIG. 14 uses a touchscreen type display, where the display is controlled by a display driver, and user touching of the screen is detected by a touch sense controller (Ctrlr). In general, the hardware elements, operating systems and programming languages of such computer and/or mobile user terminal devices also are conventional in nature.

The user device of FIG. 13 and the mobile device of FIG. 14 may also interact with the lighting device 109 in order to enhance the user experience. For example, third party applications stored as programs on such terminal equipment may correspond to programming 127 at the device 109, to allow the user to manipulate control parameters of a software configurable lighting device 109, such as image display and general illumination lighting settings. The user may also have some options to provide input to the interference mitigation strategy, e.g. selection of a particular area of the luminaire output for the display to output the light of the particular image.

The lighting device 109 in other examples is configured to perform visual light communication. Because of the beam steering (or steering) capability, the data speed and bandwidth can have an increased range. For example, beam steering and shaping provides the capability to increase the signal-to-noise ratio (SNR), which improves the visual light communication (VLC). Since the visible light is the carrier of the information, the amount of data and the distance the information may be sent may be increased by focusing the light. Beam steering allows directional control of light and that allows for concentrated power, which can be a requirement for providing highly concentrated light to a sensor. In other examples, the lighting device 109 is configured with programming that enables the lighting device 109 to "learn" behavior. For example, based on prior user interactions with the platform, the lighting device 109 will be able to use artificial intelligence algorithms stored in memory 125 to predict future user behavior with respect to a space.

As also outlined above, aspects of the techniques for operation of a software configurable lighting device 109 with the combinatorial luminaire 131 and any system interaction therewith, may involve some programming, e.g. programming of the lighting device 109 or any server or terminal device in communication with the lighting device. For example, the mobile device of FIG. 14 and the user device of FIG. 13 may interact with a server, such as the server of FIG. 12, to obtain configuration information that may be delivered to a software configurable lighting device 109. Subsequently, the mobile device of FIG. 14 and/or the user device of FIG. 13 may execute programming that permits the respective devices to interact with the software configurable lighting device 109 to provide control commands such as the ON/OFF command, an image selection or a performance command, such as dim or change beam steering angle or beam shape focus. The processor 123 of the software configurable lighting device 109 in turn runs its programming 127 to control the display device and the light source of the luminaire 131, in accordance with one or more received images, in accordance with received light performance settings from the configuration information and in accordance with the appropriate interference mitigation strategy.

Program or data aspects of the technology discussed above therefore may be thought of as "products" or "articles of manufacture" typically in the form of executable programming code (software or firmware) or data that is carried on or embodied in a type of machine readable medium. At least one medium, for example, may carry image data and an illumination light setting. Programming or control data also is embodied in the at least one medium. This programming or control data is configured to implement control of operation of a general illumination light source 110 of the luminaire 131 when outputting general illumination light responsive to the setting while the display 119 of the luminaire 131 is concurrently outputting light of an image based on the image data. The control operation mitigates interference of the illumination light output with aspects of the displayed image light output, for example, in one or more of the ways discussed above relative to FIGS. 1 to 5.

"Storage" type media include any or all of the tangible memory of lighting devices, computers, user terminal devices, intelligent standalone sensors, processors or the like, or associated modules thereof, such as various volatile or non-volatile semiconductor memories, tape drives, disk drives and the like, which non-transitory devices may provide storage at any time for executable software or firmware programming and/or any relevant data or information. All or portions of the programming and/or configuration data may at times be communicated through the Internet or various other telecommunication networks. Such communications, for example, may enable loading of the data or programming from one computer or processor into another, for example, from a management server or host computer of the lighting system service provider into any of the lighting devices 109, sensors 212, user interface devices 219, 225 or 227, other non-lighting-system devices, etc. Thus, another type of media that may bear the programming or data elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible or "storage" media, terms such as computer or machine "readable medium" refer to any medium that participates in providing instructions to a processor for execution.

The image data, light setting data, and programming or data for interference mitigation may be embodied in at least one machine readable medium, one or more of which may be non-transitory. For example, if downloaded to a lighting device 109, the image data, light setting data, and programming or data for interference mitigation could be stored in a hardware device that serves as the memory/storage 125 of the host processor system 115. The memory/storage 125 is an example of a non-transitory type of media. By way of another example, at times, executable operational programming, including programming and/or data for the interference mitigation strategy, may reside in the memory/storage 125, while actual image data and/or associated general illumination light setting data is transmitted in real time via a network medium. Interference mitigation data may reside in memory 125 or be streamed over the network medium. In these later examples, the received streaming data would be stored temporarily at the lighting device, e.g. in memory serving a buffer, for manipulation by a processor in the lighting device 109. The signal(s) on the network would be transitory in nature. However, the buffer memory and any memory or registers internal to the processor memory, or any hardware storage device used by the server to maintain the database or prepare selected data for transmission over the network would be additional examples of non-transitory media.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," "includes," "including," or any other variation thereof, are intended to cover a non-exclusive inclusion, such that a process, method, article, or apparatus that comprises or includes a list of elements or steps does not include only those elements or steps but may include other elements or steps not expressly listed or inherent to such process, method, article, or apparatus. An element preceded by "a" or "an" does not, without further constraints, preclude the existence of additional identical elements in the process, method, article, or apparatus that comprises the element.

Unless otherwise stated, any and all measurements, values, ratings, positions, magnitudes, sizes, and other specifications that are set forth in this specification, including in the claims that follow, are approximate, not exact. Such amounts are intended to have a reasonable range that is consistent with the functions to which they relate and with what is customary in the art to which they pertain. For example, unless expressly stated otherwise, a parameter value or the like may vary by as much as ±10% from the stated amount.

In addition, in the foregoing Detailed Description, it can be seen that various features are grouped together in various examples for the purpose of streamlining the disclosure. This method of disclosure is not to be interpreted as reflecting an intention that the claimed examples require more features than are expressly recited in each claim. Rather, as the following claims reflect, the subject matter to be protected lies in less than all features of any single disclosed example. Thus the following claims are hereby incorporated into the Detailed Description, with each claim standing on its own as a separately claimed subject matter.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present concepts.

What is claimed is:

1. A method, comprising steps of:

operating a first light emission matrix of a display to emit output light of an image from a luminaire that comprises the display and a general illumination light source including a second light emission matrix co-located in the luminaire with the first light emission matrix of the display, the general illumination light source and the display being configured such that, at an output of the luminaire, an available output region of the second light emission matrix at least substantially overlaps with an available output region of the first light emission matrix;

based on a characteristic of the image, selecting an area of the luminaire output where general illumination light output from the second light emission matrix will not unduly interfere with the output light of the image by the first light emission matrix; and while the first light emission matrix is emitting the output light of the image:

(a) operating a portion of the second light emission matrix, corresponding to the selected area of the luminaire output, to emit general illumination light via the selected area of the luminaire output, and (b) concurrently maintaining all unselected portions of the second light emission matrix in a neutral state, wherein one of the first and second emission matrices is at least substantially transmissive with respect to light output of the other of the first and second light emission matrices.

2. A method, comprising steps of:

operating a first light emission matrix of a display to emit output light of an image from a luminaire that comprises the display and a general illumination light source including a second light emission matrix co-located in the luminaire with the first light emission matrix of the display, the general illumination light source and the display being configured such that, at an output of the luminaire, an available output region of the second light emission matrix at least substantially overlaps with an available output region of the first light emission matrix;

based on a characteristic of the image, selecting an area of the luminaire output where general illumination light output from the second light emission matrix will not unduly interfere with the output light of the image by the first light emission matrix; and while the first light emission matrix is emitting the output light of the image:

(a) operating a portion of the second light emission matrix, corresponding to the selected area of the luminaire output, to emit general illumination light via the selected area of the luminaire output, and (b) concurrently maintaining all unselected portions of the second light emission matrix in a neutral state, wherein:

the selected area of the luminaire output corresponds to an area where the output light of the image emitted by the first light emission matrix will be a white portion of the image;

the selected area of the luminaire output is inside the area where the output light of the image emitted by the first light emission matrix will be the white portion of the image; and the unselected portions of the second light emission matrix correspond to one or more areas of the luminaire output where the output light of the image emitted by the first light emission matrix will be non-white in color.

3. A method, comprising:

operating a first light emission matrix of a display to emit output light of an image from a luminaire that comprises the display and a general illumination light source including a second light emission matrix co-located in the luminaire with the first light emission matrix of the display, the general illumination light source and the display being configured such that, at an output of the luminaire, an available output region of the second light emission matrix at least substantially overlaps with an available output region of the first light emission matrix;

based on a characteristic of the image, selecting an area of the luminaire output where general illumination light output from the second light emission matrix will not unduly interfere with the output light of the image by the first light emission matrix;

selecting a portion but not all of the luminaire output for output of the image; and while the first light emission matrix is emitting the output light of the image:

(a) operating a portion of the second light emission matrix, corresponding to the selected area of the luminaire output, to emit general illumination light via the selected area of the luminaire output, and (b) concurrently maintaining all unselected portions of the second light emission matrix in a neutral state, wherein:

the step of operating the first light emission matrix limits emission of the output light of the image to the portion of the luminaire output selected for output of the image;

the area of the luminaire output selected for emission of general illumination light is outside the portion of the luminaire output selected for output of the image; and the unselected portions of the second light emission matrix correspond to the portion of the luminaire output selected for output of the image.

4. The method of claim 1, further comprising:

determining an operating parameter intended for the general illumination light output from the luminaire, wherein:

the second light emission matrix comprises a plurality of emitters of general illumination light; and the step of operating the portion of the second light emission matrix comprises a step of operating general illumination light emitters in the portion of the second light emission matrix in a manner sufficient for the general illumination light output emitted from the luminaire to satisfy the determined operating parameter.

5. The method of claim 4, wherein:

the determined operating parameter is an intensity intended for the general illumination light output from the luminaire; and the step of operating general illumination light emitters operates a number but not all of the general illumination light emitters in the portion of the second light emission matrix, the operated number of the general illumination light emitters being sufficient to achieve the intended intensity.

6. The method of claim 4, wherein:

the determined operating parameter is an intensity intended for the general illumination light output from the luminaire; and the step of operating general illumination light emitters comprises driving the general illumination light emitters in the portion of the second light emission matrix at a power level sufficient to achieve the intended intensity.

7. The method of claim 1, wherein the first light emission matrix of the display is at least substantially transmissive with respect to light output of the second light emission matrix of the general illumination light source.

8. The method of claim 1, wherein the second light emission matrix of the general illumination light source is at least substantially transmissive with respect to light output of the first light emission matrix of the display.

9. The method of claim 1 wherein:

the first light emission matrix of the display comprises a matrix of display pixel emitters, each display pixel emitter being controllable to emit selected amounts of three or more different colors;

the second light emission matrix of the general illumination light source comprises a matrix of white light emitters; and each white light emitter of the second light emission matrix is co-located of the with a display pixel emitter of the first light emission matrix.

10. A lighting device, comprising:

a display comprising a first light emission matrix configured to output light from selected areas of the first emission matrix as a representation of an image;

a controllable general illumination light source comprising a second light emission matrix configured to output illumination light from the second light emission matrix, wherein the general illumination light source is co-located with the display such that an available output region of the second light emission matrix at least substantially overlaps an available output region of the first light emission matrix;

a driver system coupled to control light outputs generated by the first and second light emission matrices; and a processor coupled to the driver system, wherein the processor is configured to operate the general illumination light source and the display via the driver system to implement functions, including functions to:

operate the first light emission matrix to output the light of the image via an output of the luminaire;

based on a characteristic of the image output, select an area of the output of the luminaire where general illumination light output from the second light emission matrix will not unduly interfere with the output light of the image by the first light emission matrix; and while the first light emission matrix is emitting the light of the image:

(a) operate a portion of the second light emission matrix, corresponding to the selected area of the luminaire output, to emit the general illumination light via the selected area of the luminaire output, and (b) concurrently, maintain all unselected portions of the second light emission matrix in a neutral state, wherein one of the first and second light emission matrices is at least substantially transmissive with respect to light output of the other of the first and second light emission matrices.

11. A lighting device, comprising:

a display comprising a first light emission matrix configured to output light from selected areas of the first emission matrix as a representation of an image;

a controllable general illumination light source comprising a second light emission matrix configured to output illumination light from the second light emission matrix, wherein the general illumination light source is co-located with the display such that an available output region of the second light emission matrix at least substantially overlaps an available output region of the first light emission matrix;

a driver system coupled to control light outputs generated by the first and second light emission matrices; and a processor coupled to the driver system, wherein the processor is configured to operate the general illumination light source and the display via the driver system to implement functions, including functions to:

operate the first light emission matrix to output the light of the image via an output of the luminaire;

based on a characteristic of the image output, select an area of the output of the luminaire where general illumination light output from the second light emission matrix will not unduly interfere with the output light of the image by the first light emission matrix; and while the first light emission matrix is emitting the light of the image:

(a) operate a portion of the second light emission matrix, corresponding to the selected area of the luminaire output, to emit the general illumination light via the selected area of the luminaire output, and (b) concurrently, maintain all unselected portions of the second light emission matrix in a neutral state, wherein:

the selected area of the luminaire output corresponds to an area where the light of the image output by the first light emission matrix will be a white portion of the image;

the selected area of the luminaire output is inside the area where the light of the image output by the first light emission matrix will be the white portion of the image; and the unselected portions of the second light emission matrix correspond to one or more areas of the luminaire output where the light of the image output by the first light emission matrix will be non-white in color.

12. A lighting device, comprising:

a display comprising a first light emission matrix configured to output light from selected areas of the first emission matrix as a representation of an image;

a controllable general illumination light source comprising a second light emission matrix configured to output illumination light from the second light emission matrix, wherein the general illumination light source is co-located with the display such that an available output region of the second light emission matrix at least substantially overlaps an available output region of the first light emission matrix;

a driver system coupled to control light outputs generated by the first and second light emission matrices; and a processor coupled to the driver system, wherein the processor is configured to operate the general illumination light source and the display via the driver system to implement functions, including functions to:

operate the first light emission matrix to output the light of the image via an output of the luminaire;

based on a characteristic of the image output, select an area of the output of the luminaire where general illumination light output from the second light emission matrix will not unduly interfere with the output light of the image by the first light emission matrix; and while the first light emission matrix is emitting the light of the image:

(a) operate a portion of the second light emission matrix, corresponding to the selected area of the luminaire output, to emit the general illumination light via the selected area of the luminaire output, and (b) concurrently, maintain all unselected portions of the second light emission matrix in a neutral state, wherein:

the processor is further configured to select a portion but not all of the luminaire output for output of the image;

the function to operate the first light emission matrix limits output of the image light to the portion of the luminaire output selected for output of the image;

the area of the luminaire output selected for emission of general illumination light is outside the portion of the luminaire output selected for output of the image; and the unselected portions of the second light emission matrix correspond to the portion of the luminaire output selected for output of the image.

13. The lighting device of claim 10, wherein the first light emission matrix of the display is at least substantially transmissive with respect to light output of the second light emission matrix of the general illumination light source.

14. The lighting device of claim 10, wherein the second light emission matrix of the general illumination light source is at least substantially transmissive with respect to light output of the first light emission matrix of the display.

15. A lighting device, comprising:

a display comprising a first light emission matrix configured to output light from selected areas of the first emission matrix as a representation of an image;

a controllable general illumination light source comprising a second light emission matrix configured to output illumination light from the second light emission matrix, wherein the general illumination light source is co-located with the display such that an available output region of the second light emission matrix at least substantially overlaps an available output region of the first light emission matrix, and a driver system coupled to control light outputs generated by the first and second light emission matrices; and a processor coupled to the driver system, wherein the processor is configured to operate the general illumination light source and the display via the driver system to implement functions, including functions to:

operate the first light emission matrix to output the light of the image via an output of the luminaire;

based on a characteristic of the image output, select an area of the output of the luminaire where general illumination light output from the second light emission matrix will not unduly interfere with the output light of the image by the first light emission matrix; and while the first light emission matrix is emitting the light of the image:

(a) operate a portion of the second light emission matrix, corresponding to the selected area of the luminaire output, to emit the general illumination light via the selected area of the luminaire output, and (b) concurrently, maintain all unselected portions of the second light emission matrix in a neutral state, wherein:

the first light emission matrix of the display comprises a matrix of display pixel emitters, each display pixel emitter being controllable to emit selected amounts of three or more different colors;

the second light emission matrix of the general illumination light source comprises a matrix of white light emitters; and each white light emitter of the second light emission matrix is co-located with a display pixel emitter of the first light emission matrix.

16. A lighting device, comprising:

a luminaire comprising:

a display comprising a first light emission matrix configured to output light from selected areas of the first emission matrix as a representation of an image;

a controllable general illumination light source comprising a second light emission matrix configured to output illumination light from the second light emission matrix, wherein:

the general illumination light source is co-located with the display such that an available output region of the second light emission matrix at least substantially overlaps an available output region of the first light emission matrix, and one of the first and second light emission matrices is at least substantially transmissive with respect to light output of the other of the first and second light emission matrices; and a controller configured to:

operate the luminaire to emit light of an image via an output of the luminaire; and while the luminaire is emitting the light of the image, operate selected portions of the first and second light emission matrices of to:

(a) emit the general illumination light via an area of the luminaire output where the general illumination light output will not unduly interfere with the emitted light of the image, and (b) concurrently not output general illumination light via all other areas of the luminaire output where the general illumination light output would unduly interfere with the emitted light of the image.

17. A lighting device, comprising:

a luminaire comprising:

a display comprising a first light emission matrix configured to output light from selected areas of the first emission matrix as a representation of an image;

a controllable general illumination light source comprising a second light emission matrix configured to output illumination light from the second light emission matrix, wherein:

the general illumination light source is co-located with the display such that an available output region of the second light emission matrix at least substantially overlaps an available output region of the first light emission matrix, and one of the first and second light emission matrices is at least substantially transmissive with respect to light output of the other of the first and second light emission matrices; and means for controlling at least one of the first and second light emission matrices of light emitters to mitigate interference of illumination light output with concurrently emitted light of the image.

* * * * *